US008162637B2

(12) United States Patent
Sauget

(10) Patent No.: US 8,162,637 B2
(45) Date of Patent: Apr. 24, 2012

(54) ROTARY MACHINE HAVING FRUSTO-CONICAL ELEMENTS

(76) Inventor: Yves Sauget, Montreal (CA)

( * ) Notice: Subject to any disclaimer, the term of this patent is extended or adjusted under 35 U.S.C. 154(b) by 518 days.

(21) Appl. No.: 12/377,589

(22) PCT Filed: Aug. 17, 2007

(86) PCT No.: PCT/CA2007/001450

§ 371 (c)(1),
(2), (4) Date: Feb. 13, 2009

(87) PCT Pub. No.: WO2008/019506

PCT Pub. Date: Feb. 21, 2008

(65) Prior Publication Data

US 2010/0003154 A1 Jan. 7, 2010

Related U.S. Application Data

(60) Provisional application No. 60/838,188, filed on Aug. 17, 2006.

(51) Int. Cl.
*F03C 4/00* (2006.01)
*F04C 2/00* (2006.01)
*F04C 18/00* (2006.01)

(52) U.S. Cl. ..... 418/196; 418/68; 418/195; 123/241

(58) Field of Classification Search ..... 418/61.2, 418/68, 195, 196, 49–53; 123/241
See application file for complete search history.

(56) References Cited

U.S. PATENT DOCUMENTS

| | | | | |
|---|---|---|---|---|
| 769,082 | A | 8/1904 | Hendricks | |
| 2,031,125 | A | 2/1936 | Peschl | |
| 2,359,657 | A | 10/1944 | McCleary | |
| 2,482,325 | A | 9/1949 | Davis | |
| 3,129,460 | A * | 4/1964 | Berger | 418/195 |
| 3,229,677 | A | 1/1966 | Hughes | |
| 3,240,156 | A | 3/1966 | Hartley | |
| 3,277,792 | A | 10/1966 | Stenerson | |
| 3,492,974 | A | 2/1970 | Kreimeyer | |
| 3,915,601 | A | 10/1975 | Keplinger et al. | |
| 3,990,410 | A | 11/1976 | Fishman | |
| 4,413,486 | A | 11/1983 | Irwin | |
| 4,603,595 | A | 8/1986 | Lew et al. | |
| 4,721,079 | A | 1/1988 | Lien | |
| 4,877,379 | A | 10/1989 | Okabe | |
| 4,979,882 | A | 12/1990 | Wipf | |
| 5,336,067 | A | 8/1994 | Lim | |

(Continued)

FOREIGN PATENT DOCUMENTS

DE 3241253 A1 * 5/1984

(Continued)

*Primary Examiner* — Theresa Trieu

(74) *Attorney, Agent, or Firm* — Knobbe Martens Olson & Bear LLP

(57) ABSTRACT

A system for enabling fluid flow is provided which includes a plurality of frusto-conical elements and central and outer spherical shells which enclose the frusto-conical elements. The elements are constrained between the central and outer spherical shells, and an input and an output allow fluid flow into and out of the system. The geometry of the frusto-conical elements and their alignment within the system allows the formation of chambers between adjacent elements and their central and outer shells. The elements are free to roll about one another within the system in a synchronized manner. This synchronized rolling is results in a cyclical change in volume of those chambers.

14 Claims, 21 Drawing Sheets

U.S. PATENT DOCUMENTS

| | | | | |
|---|---|---|---|---|
| 5,341,782 | A * | 8/1994 | McCall et al. | 418/196 |
| 5,408,849 | A | 4/1995 | Schimko et al. | |
| 6,390,052 | B1 | 5/2002 | McMaster et al. | |
| 6,988,482 | B2 | 1/2006 | Lockett | |
| 7,527,485 | B2 * | 5/2009 | Coffland | 418/196 |
| 2006/0118078 | A1 | 6/2006 | Coffland | |
| 2006/0210419 | A1 * | 9/2006 | Chadwick, II | 418/196 |

FOREIGN PATENT DOCUMENTS

| | | | |
|---|---|---|---|
| DE | 3905882 | A1 * | 9/1990 |
| JP | 52029514 | A * | 3/1977 |

* cited by examiner

| position | Fixed trihedron | Spaces | Fixed frustum |
|---|---|---|---|
| 0° |  | X max<br>Y expanding<br>Z contracting<br><br>*Y and Z are equal* |  |
| 15° |  | X contracting<br>Y expanding<br>Z contracting |  |
| 30° |  | X contracting<br>Y expanding<br>Z min<br><br>*X and Y are equal* |  |
| 45° |  | X contracting<br>Y expanding<br>Z expanding |  |

| position | Fixed trihedron | Spaces | Fixed frustum |
|---|---|---|---|
| 60° |  | X contracting<br>Y max<br>Z expanding<br><br>*X and Z are equal* |  |
| 75° |  | X contracting<br>Y contracting<br>Z expanding |  |
| 90° |  | X min<br>Y contracting<br>Z expanding<br><br>*Y and Z are equal* |  |
| 105° |  | X expanding<br>Y contracting<br>Z expanding |  |

| position | Fixed trihedron | Spaces | Fixed frustum |
|---|---|---|---|
| 120° |  | X expanding<br>Y contracting<br>Z max<br><br>*X and Y are equal* |  |
| 135° |  | X expanding<br>Y contracting<br>Z contracting |  |
| 150° |  | X expanding<br>Y min<br>Z contracting<br><br>*X and Z are equal* |  |
| 165° |  | X expanding<br>Y expanding<br>Z contracting |  |

FIG. 8D
| position | Fixed trihedron | Spaces | Fixed frustum |
|---|---|---|---|
| 180° | 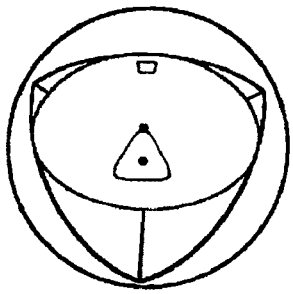 | X max<br>Y expanding<br>Z contracting<br><br>*Y and Z are equal* | 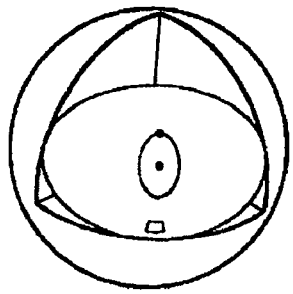 |
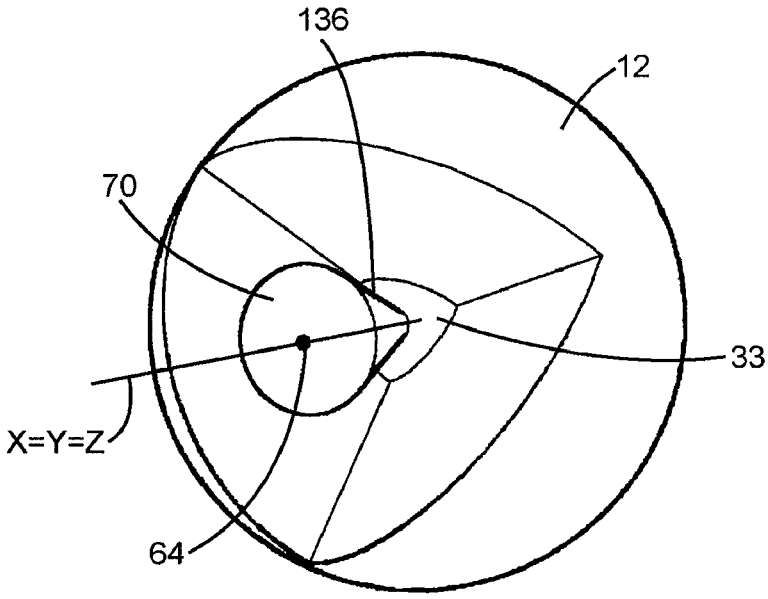
FIG. 9
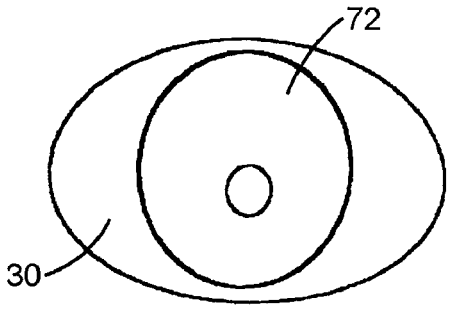
FIG. 10

| position | Fixed trihedron | Fixed frustum |
|---|---|---|
| 0° |   |   |
| 15° |  |  |
| 30° |  |  |
| 45° |  |  |

FIG. 11B
| position | Fixed trihedron | Fixed frustum |
|---|---|---|
| 60° | 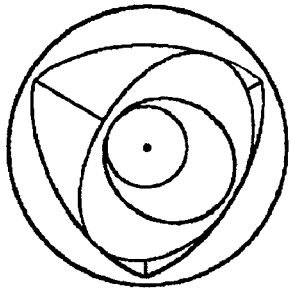 | 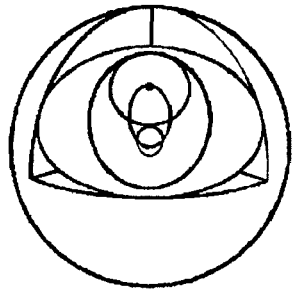 |
| 75° | 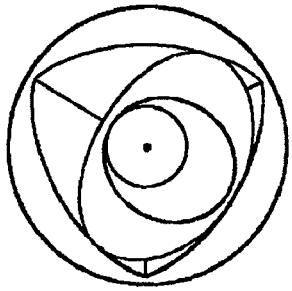 | 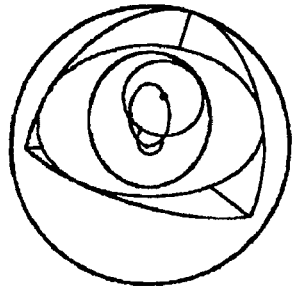 |
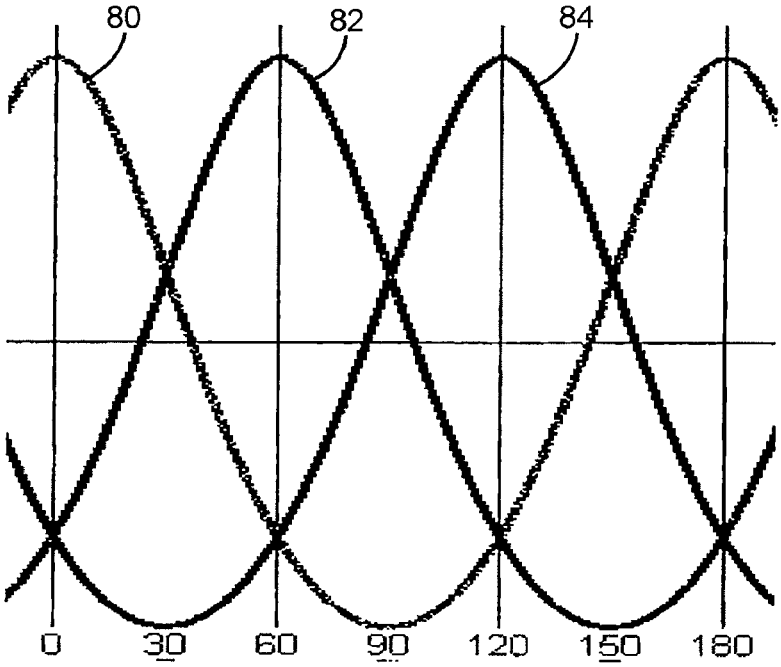
FIG. 12

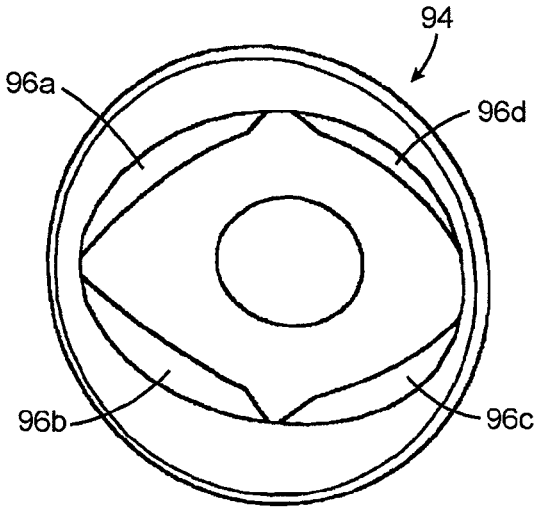
FIG. 13A
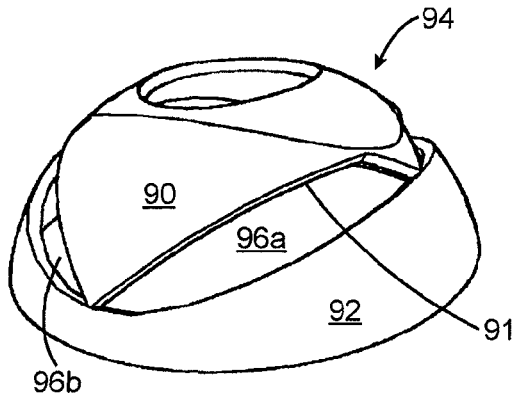
FIG. 13B
FIG. 14A
| Pos. | Y | X | Z | Space |
|---|---|---|---|---|
| 0° | 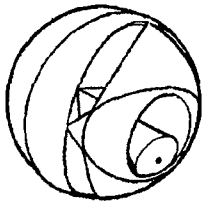 | 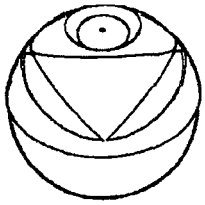 | 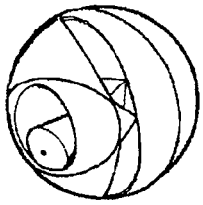 | Y expanding input<br>X maximum -<br>Z contracting output |
| 15° | 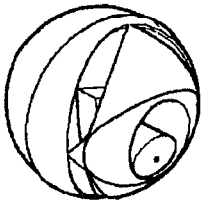 | 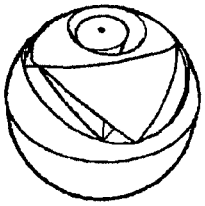 | 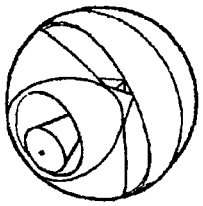 | Y expanding input<br>X contracting output<br>Z contracting output |
| 30° | 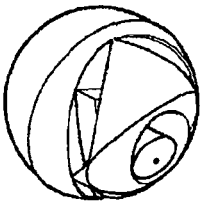 | 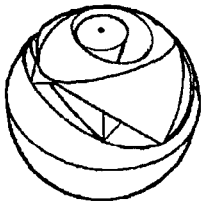 | 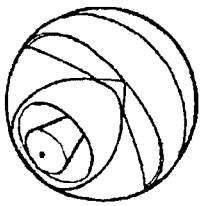 | Y expanding input<br>X contracting output<br>Z minimum - |
| 45° | 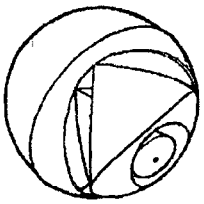 | 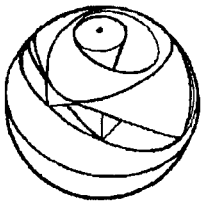 | 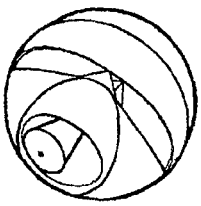 | Y expanding input<br>X contracting output<br>Z expanding input |

FIG. 14B
| Pos. | Y | X | Z | Space |
|---|---|---|---|---|
| 60° | 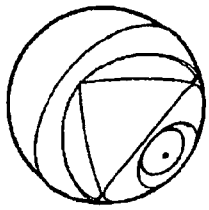 | 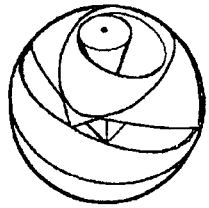 | 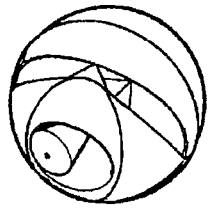 | Y maximum -<br>X contracting output<br>Z expanding input |
| 75° | 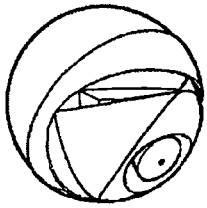 | 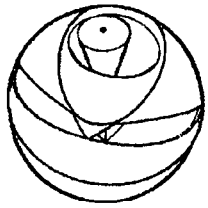 | 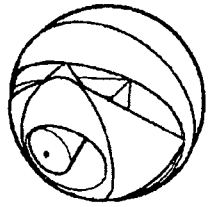 | Y contracting output<br>X contracting output<br>Z expanding input |
| 90° | 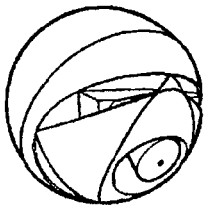 | 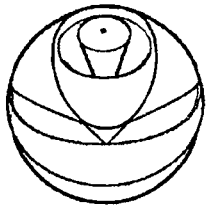 | 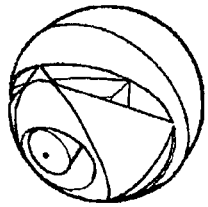 | Y contracting output<br>X minimum -<br>Z expanding input |
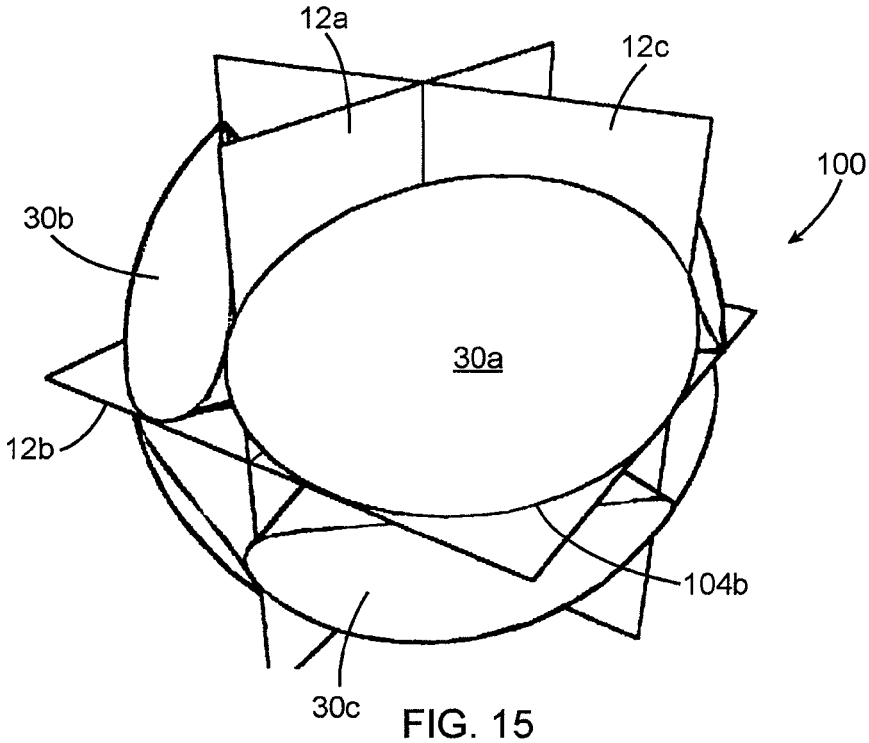
FIG. 15

ROTARY MACHINE HAVING FRUSTO-CONICAL ELEMENTS

This application claims priority to U.S. Provisional Application 60/838,188 filed on Aug. 17, 2006.

FIELD OF THE INVENTION

The present invention relates to a system of frusto-conical elements and the use thereof. More particularly, the present invention relates to a second degree conical elliptical frusto-conical element to be used, for example, in the field of power transmission, generation and the like.

BACKGROUND OF THE INVENTION

Conventional systems, such as turbines, engines and the like, used for power transmission, generation and the like are well known in the art. Also known in the art are the different disadvantages associated with conventional systems, for example, the fact that they are designed to be very task specific.

It is also known to provide a system of oblong elements which form chambers therebetween and to rotate these elements so as to vary the volume of these chambers, as described in U.S. patent application Ser. No. 11/006,407, filed Dec. 7, 2004 by Coffland and published Jun. 8, 2006 as 2006/0118078. Specifically, COFFLAND teaches a plurality of oblong elements, disposed either flat or around a sphere, which pivot about a central axis. Each oblong element is created by intersecting various circles of different radii. For example, an elliptical-like shape is given to the elements by using sections of two circles to form longitudinal sides which are separated at either end by sections of two relatively smaller circles. Sets of three or four elements are then positioned next to one another on a surface such that their circumferential surfaces are in contact and so as to create spaces therebetween. As the elements rotate about their central axes, the spaces change in volume as the elements remain in contact. This change in volume can be utilised by feeding a fluid into and out of these spaces via passageways provided through the elements which open onto their circumferential surfaces.

However, numerous disadvantages are present in this system as taught by COFFLAND. The elements, as taught by COFFLAND, rotate about their respective geometric centers, and in order to maintain contact must all rotate all in the same clockwise or anti-clockwise direction. A result of this arrangement is that the circumferential surfaces of two adjacent elements are in fact traveling in opposite directions along their line of contact. As will be apparent to one of ordinary skill in the art, this will result in a frictional resistance between to two elements and possible damage due to scrubbing.

In addition, as taught by COFFLAND, the passageways for feeding fluid into and out of the spaces pass through a given element and open into an adjacent space through its circumferential surface. Because the circumferential surface is also the surface along which adjacent elements are in contact, as this line of contact between two adjacent elements passes over such an opening in one of the two elements it will inadvertently put two adjacent spaces in fluid communication.

In view of the above, there remains a need for a system for enabling fluid flow which overcomes, inter alia, the aforementioned limitations of the prior art.

Also known in the art are the following patents and published applications which describe rotational motors or pumps and the like: U.S. Pat. No. 769,082; U.S. Pat. No. 2,031,125; U.S. Pat. No. 2,359,657; U.S. Pat. No. 2,482,325; U.S. Pat. No. 3,229,677; U.S. Pat. No. 3,240,156; U.S. Pat. No. 3,277,792; U.S. Pat. No. 3,492,974; U.S. Pat. No. 3,915,601; U.S. Pat. No. 3,990,410; U.S. Pat. No. 4,413,486; U.S. Pat. No. 4,603,595; U.S. Pat. No. 4,721,079; U.S. Pat. No. 4,877,379; U.S. Pat. No. 5,336,067; U.S. Pat. No. 5,408,849; U.S. Pat. No. 6,390,052; U.S. Pat. No. 6,988,482; and US 2006/0118078.

SUMMARY OF THE INVENTION

An object of the present invention is to provide a system which, by virtue of its design and components, satisfies some of the above-mentioned needs and is thus an improvement over other related systems and/or related methods known in the prior art.

In accordance with the present invention, the above system is achieved, as will be easily understood by one skilled in the art, with a system comprising a plurality of frusto-conical elements such as briefly described herein and such as exemplified in the accompanying drawings.

More particularly, a system for enabling fluid flow is provided including a plurality of frusto-conical elements, a spherical central shell, a spherical outer shell enclosing the central shell and the plurality of frusto-conical elements, the outer shell having a radius, constraining means for constraining the frusto-conical elements between the central and outer shells, and input and output means for allowing fluid flow into and out of the chambers. Each frusto-conical element includes a first spherical surface having a first radius, a second spherical surface having a second radius, the first and second spherical surfaces sharing a common geometric center, and a lateral surface extending between the first and second spherical surfaces. The lateral surface is formed from a section of an elliptical cone and tapers from the second spherical surface to the first spherical surface. The apex of the elliptical cone coincides with the geometric centre of the first and second spherical surfaces. The spherical central shell has a radius matching the first radius. The outer shell has a radius matching the second radius. The constraining means constrain the frusto-conical elements such that the first spherical surface of each frusto-conical element engages the central shell, the second spherical surface of each frusto-conical element engages the outer shell, each frusto-conical element is in linear contact with at least two adjacent frusto-conical elements along their respective lateral surfaces, a plurality of chambers are created between at least some adjacent frusto-conical elements and the central and outer shells, and the frusto-conical elements are free to roll about one another along their lateral surfaces in a synchronised manner so as to allow a synchronised rolling, and the synchronised rolling of the frusto-conical elements results in a corresponding synchronised and cyclical change in volume of the chambers.

Preferably, the constraining means include a plurality of pseudo-elliptical guides for guiding the rolling of the frusto-conical elements, each pseudo-elliptical guide is provided on one of the first and second spherical surfaces of a respective one of the frusto-conical elements, each pseudo-elliptical guide being centered on the one of the first and second spherical surfaces; and a plurality of rollers which each engage a respective one of the pseudo-elliptical guides. Each roller includes an outer conical surface for engaging the respective one of the pseudo-elliptical guides, and an axis about which the roller is operable to rotate as the respective one of the frusto-conical elements rolls thereabout. The rolling of the frusto-conical elements about the rollers guides the rolling of the frusto-conical elements about each other.

Preferably, each pseudo-elliptical guide includes a pseudo-elliptical channel cut into the one of the first and second spherical surfaces of the respective one of the frusto-conical elements and each pseudo-elliptical channel comprises a channel wall. The outer conical surface of each roller engages a respective channel wall.

Preferably, the input and output means include an input opening in the outer shell for receiving the fluid flow, an input channel extending through a first of the frusto-conical elements and in fluid communication with the input opening, an output opening in the outer shell for releasing the fluid flow, an output channel extending through a second of the frusto-conical elements and in fluid communication with the output opening, a first internal channel located within the central shell allowing fluid to flow from the input channel therethrough and into one of the chambers, and a second internal channel located within the central shell allowing fluid to flow from the one of the chambers through the central shell and into the output channel.

Preferably, each frusto-conical element comprises first and second focal axes passing therethrough and intersecting the second surface, and the constraining means comprise a plurality of rigid links for pivotally linking pairs of adjacent frusto-conical elements. Each rigid link has first and second extremities pivotally attached to adjacent frusto-conical elements proximate their respective second spherical surfaces and operable to pivot about their respective first focal axes.

Preferably, the input and output means include an input opening in one of the central and outer shells for receiving the fluid flow, and an output opening in one of the central and outer shells for releasing the fluid. The input opening is positioned with respect to the frusto-conical elements so as to be aligned with one of the chambers for a pre-determined portion of its cyclical change in volume. The output opening is positioned with respect to the frusto-conical elements so as to be aligned with the one of the chambers for another pre-determined portion of its cyclical change in volume.

Preferably the constraining means include an extending portion protruding from around the lateral surface of a first frusto-conical element and a complementary portion extending around lateral surface of a second frusto-conical element. The extending portion and the complementary portion of adjacent frusto-conical elements are operative to align and engage as they roll about one another.

As will be appreciated by one of ordinary skill in the art, a system according to the present invention can advantageously be used to generate and/or transform various types of energy, such as, but not limited to, hydraulic, mechanical, pneumatic and electrical energy.

Furthermore, a system according to the present invention provides frusto-conical elements which roll about one another, rather than which rotate about a central axis. It will be appreciated that such a synchronised rolling movement drastically reduces the friction between contacting elements.

The objects, advantages and other features of the present invention will become more apparent upon reading of the following non-restrictive description of preferred embodiments thereof, given for the purpose of exemplification only with reference to the accompanying drawings.

BRIEF DESCRIPTION OF THE DRAWINGS

The invention will be better understood upon reading the following non-restrictive description of the preferred embodiment thereof, made with reference to the accompanying drawings in which:

FIGS. 8A-8D are a table illustrating the positions of the frusto-conical element and the spherically completed trihedron during a cycle.

FIG. 9 is an isometric view of a trihedron further comprising a circular cone.

FIG. 10 is a top view of a frusto-conical element further comprising a pseudo-elliptical channel.

FIGS. 11A-11B are a table illustrating the positions of the frusto-conical element comprising a pseudo-elliptical channel and those of the spherically completed trihedron comprising a circular cone.

FIG. 12 is a graph of variations of spaces during the cycle illustrated in the previous FIGS.

FIGS. 13A and 13B are bottom and isometric views of a frusto-conical element cover.

FIGS. 14A-14B are a table illustrating the positions of a cover with regard to three spaces.

FIG. 15 is an isometric view of a system of frusto-conical elements aligned about a trihedron.

DETAILED DESCRIPTION OF PREFERRED EMBODIMENTS OF THE INVENTION

In the following description, the same numerical references refer to similar elements. The embodiments shown in the figures are preferred, for exemplification purposes only.

Described herein is a system for enabling fluid flow and can be used in the field of power transmission, generation and the like. The system includes a plurality of frusto-conical elements, central and outer spherical shells which enclose the frusto-conical elements, constraining means which constrain the elements between the central and outer spherical shells, and input and output means for allowing fluid flow into and out of the system.

The geometry of the frusto-conical elements and their alignment within the system allows the formation of chambers between adjacent elements and their central and outer shells. The elements are free to roll about one another within the system in a synchronized manner. This synchronized rolling is results in a cyclical change in volume of those chambers.

The sections below explain in more detail the elements of the system according to preferred embodiments of the invention and their interactions.

Geometry of a Frusto-Conical Element

Figure 1:
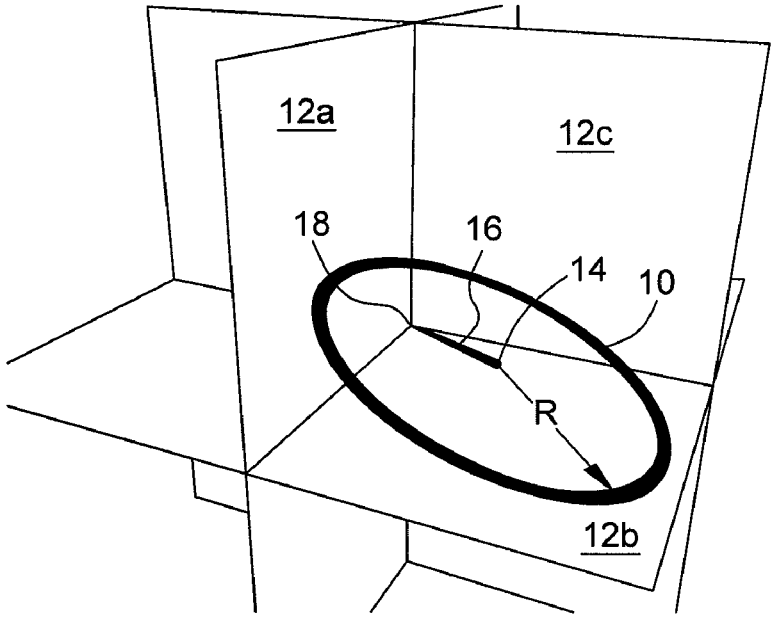
FIG. 1 is an isometric view of a circle of radius R within a trihedron.

FIG. 1 shows a circle 10 of radius R in contact with the three planes 12*a*, 12*b*, and 12*c* of a rectangular trihedron 12. The center 14 of the circle 10 is a distance 16 from the origin 18 of the trihedron 12, while the circle 10 is constrained to contact each of the planes 12*a*, 12*b* and 12*c*, at any given time.

Figure 2A:
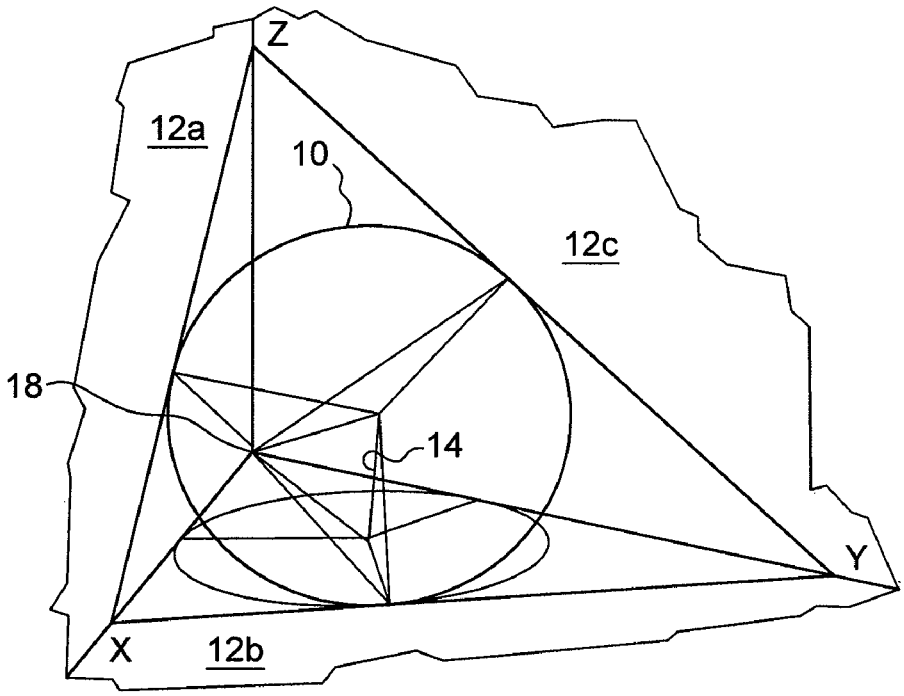
FIGS. 2A to 2C are geometric representations of the circle in FIG. 1.
Figure 2B:
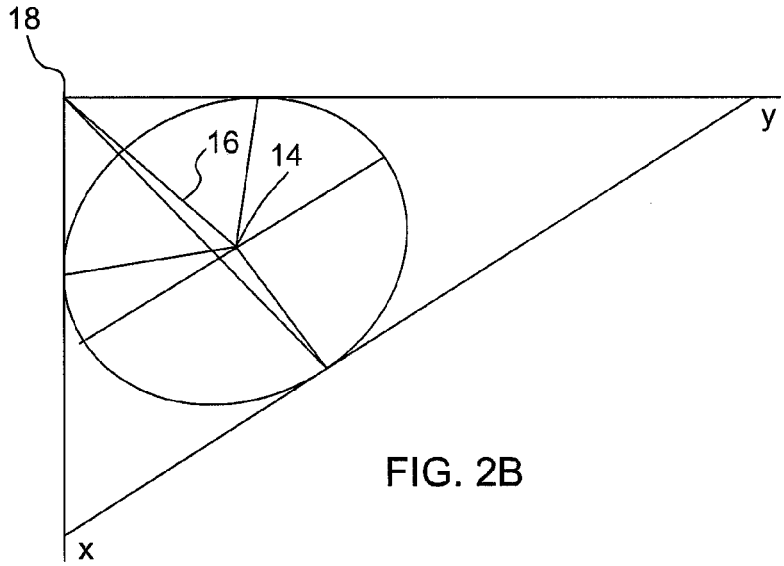

With reference to FIGS. 2A and 2B, it can be shown that the distance 16 between the center 14 of the circle 10 and the origin 18 of the trihedron 12 is constant when the circle 10 is constrained to contact each of planes 12*a*, 12*b* and 12*c*. By projecting the circle 10 onto any of the planes of the trihedron 12, for example plane 12*b* as shown in FIG. 2B, it can be seen that distance 16=R*√(2). Moreover, the resultant projection figure corresponds to Monge's circle wherein the square of the distance between the origin 18 and the projection of center 14 equals the sum of the squares of the minor and major axes of the elliptical project of circle 10.

Figure 2C:
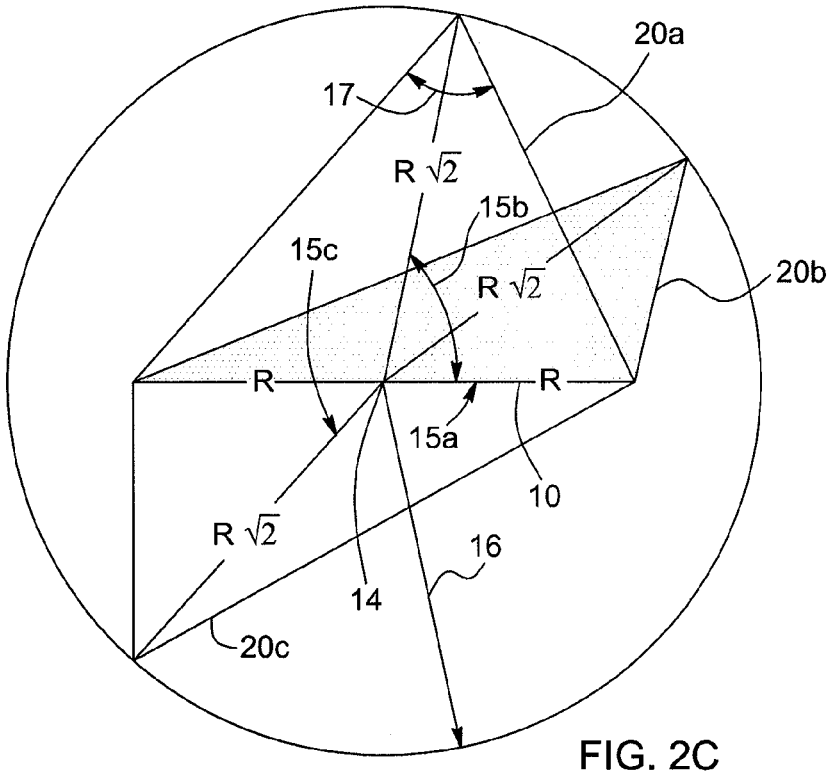

FIG. 2C, for its part, illustrates the circle 10 from the frame of reference of the circle 10 in line with the plane of the circle 10. From this point of view, the circle 10 appears as a line of length 2*R. Furthermore, in the frame of reference of the circle 10, the locus of possible positions of the origin 18 relative to the circle 10 forms a circle thereabout since the distance 16 between the center 14 and the origin constant at R*√(2), in accordance with the above-noted constraints.

Further provided are three triangles 20*a*, 20*b* and 20*c* generated by fixing their respective angles 15*a*, 15*b* and 15*c* between the plane of the circle 10 and the origin 18, which are included herein for exemplification purposes and are in no way to be considered limiting.

Figure 3:
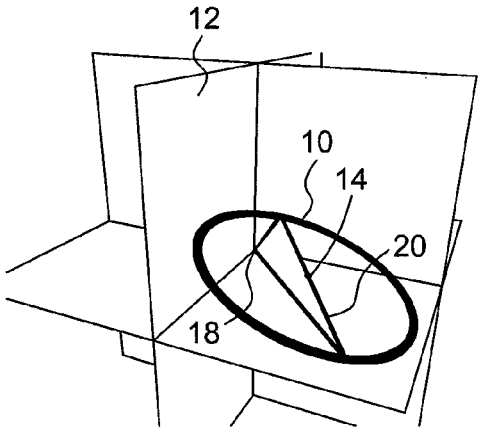
FIG. 3 is an isometric view of the circle of the previous figures with a further constraint.

The circle 10 is further constrained within the trihedron 12 by fixing the angle 15 between the plane of the circle 10 and the segment 16, as illustrated in FIG. 3. A triangle 20 is constructed as seen in FIG. 2C having first and second vertices on opposing points of the circle 10 and a third vertex at the origin 18 of the trihedron 12. At origin 18, an angle 17 is formed.

With the circle 10 constrained by the triangle 20 in this manner, the circle 10 remains free to rotate within the trihedron 12. With this additional constraint, the location of the center 14 is limited to a curve drawn on the previously-noted spherical surface. As will be apparent to one of ordinary skill in the art, defining the triangle 20 with different angles 15 (and, thus angles 17 as well) will vary the possible positions of the center 14 and the circle 10 within the trihedron 12.

Two specific embodiments of the triangle 20 and the angle 15 are worth considering: a) when the angle 15 is 90° or 270°, the triangle 20 is an isosceles triangle, the center 14 is fixed and at equidistant from each of planes 12*a*, 12*b* and 12*c*, and the triangle 20 is unable to move within the trihedron 12 other than to spin about the line passing through the center 14 and the origin 18; and b) when the angle 15 is 0° or 180°, the triangle 20 is merely a straight line and the center 14 can move on three circular arcs along each of planes 12*a*, 12*b* and 12*c*. For the purposes of the present description however, these limiting cases will not be considered further herein. However, it is to be noted that such embodiments remain within the scope of the present invention.

Figure 4:
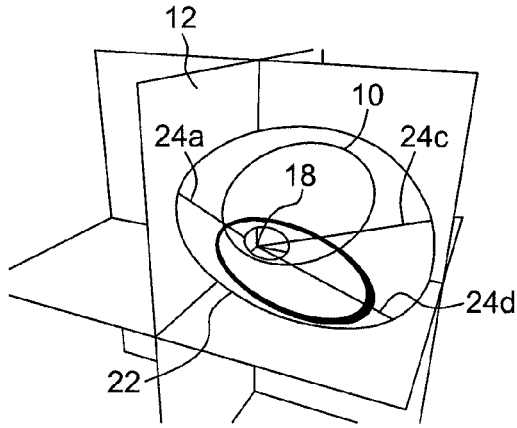
FIG. 4 is an isometric view of a cone generated by the circle of the previous figures.
Figure 5A:
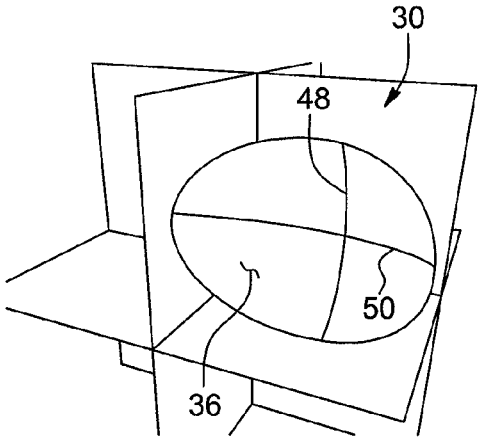
FIGS. 5A and 5B are isometric views of a frusto-conical element generated from the cone of FIG. 4.
Figure 5B:
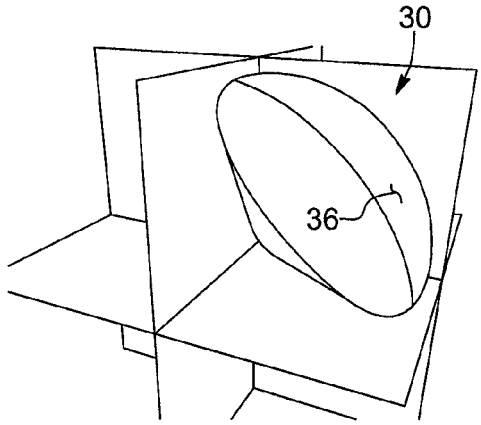
Figure 6A:
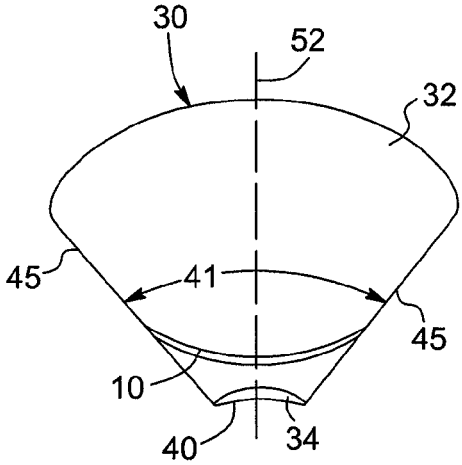
FIGS. 6A to 6C are isometric views of the frusto-conical element of FIGS. 5A and 5B.
Figure 6B:
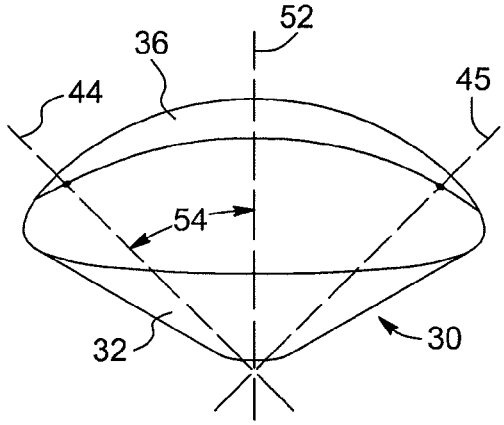
Figure 6C:
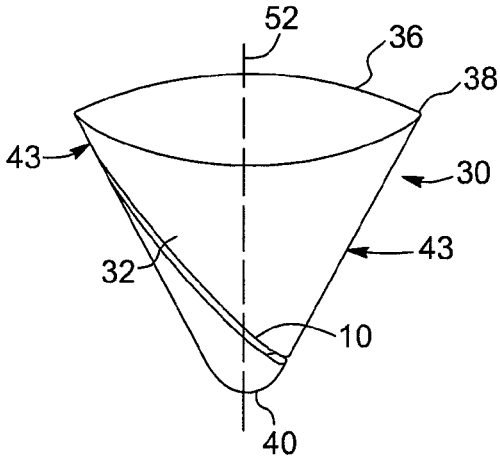

As illustrated in FIG. 4 a cone 22 having a vertex at the origin 18 of the trihedron 12 is generated by sweeping the fully constrained circle 10 within trihedron 12. The cone 22 is of the second degree and therefore is subject to the number of known properties of secondary cones. As the circle 10 is constrained to contact each of three planes 12*a*, 12*b* and 12*c*, the cone 22 is thereby tangent to the planes along axes 24*a*, 24*b* and 24*c*. As will be apparent to one of ordinary skill in the art, the axes 24*a*, 24*b* and 24*c* are not fixed lines on the cone 22, but rather represent the lines of contact which vary depending on the position of the cone within the trihedron 12. Note that in FIG. 4, the cone 22 is truncated in order to provide a better visualisation.

For any position of the cone 22 within the trihedron 12, the cone 22 creates three separate areas within the trihedron 12 and exterior to the cone 22. These areas are separated by the contact between the cone 22 and the trihedron 12 along axes 24*a*, 24*b* and 24*c*.

By enclosing the truncated cone 22 between two concentric spheres whose geometric centers coincide with the trihedron origin 18, the remaining formation is a portion of an elliptical cone, bound by two spherical surfaces, hence a second degree conical elliptical frustum. For simplicity however, this will be hereinafter be referred to as frusto-conical element 30.

With reference to FIGS. 5A, 5B, and 6A to 6C, the frusto-conical element 30 comprises a lateral surface 32 which is formed from a section of the elliptical cone 22, a first spherical surface 34 having a first radius and a second spherical surface 36 having a second radius. Because of their relationship with the system of frusto-conical elements, which will be described in detail further below, the first and second spherical surfaces 34 and 36 will hereinafter be referred to as inner and outer surfaces 34 and 36. The first and second spherical surfaces are concentric and their geometric center coincides with the apex of the elliptical cone 22. The boundary between the outer spherical surface 36 and the lateral surface 32 is an elliptical perimeter 38, however as will be apparent to one skilled in the art, this perimeter is of the second degree, and therefore not a curve in a plane but rather in 3-dimensional space.

A similar, although smaller, elliptical perimeter 40 is located between the lateral surface 32 and the inner spherical surface 34.

Geometric Properties

Due to its conical-elliptical nature, the major angle 41 and a minor angle 42 of the frusto-conical element 30 can be described wherein the major angle 41 is greater than the minor 42. Similarly, the frusto-conical element 30 possesses major and minor planes 48 and 50 comprising the major and minor angles 41 and 42, respectively, which are perpendicular to one another and serve to define major and minor planes of symmetry, as in a planar ellipse.

In keeping with this elliptical nature, the frusto-conical element 30 can broadly be described as having opposing major sides 43 which are roughly in the region parallel to the plane of the major angle 41, and opposing minor sides 45 which are roughly in the region parallel to the plane of the minor angle 42. Because the lateral surface 32 is both conical and elliptical, it is to be understood that major and minor sides 43 and 45 do not represent strictly defined surfaces, but rather general areas.

As will be apparent to one of ordinary skill in the art, the minor angle 42 is equal to the angle 17 of triangle 20, as seen in FIGS. 2C and 3.

Furthermore, as an elliptical conic of the second degree, frusto-conical element 30 further includes first and second focal axes 44 and 46. In contrast to the two foci of a planar ellipse which are mere points, the focal axes 44 and 46 are linear and pass through the origin 18. Similar to the foci of a planar ellipse, focal axes 44 and 46 are contained in the major plane 48 and can be considered to be the set of foci of every ellipse between the two spherical surfaces 34 and 36 contained on concentric spherical planes therebetween.

The intersection of the major and minor planes 48 and 50 defines the central axis 52 of the frusto-conical element 30, which passes through the origin 18.

In the major plane 48 each of the focal axes 44 and 46 are an angle 54 (hereinafter referred to also as the focus angle 54) with the central axis 52.

While planar ellipses are defined as the locus of all points in a plane, the sum of whose distances from two fixed points (the foci) is a constant, an elliptical conic of the second degree is the locus of all axes, the sum of whose angular distances from the focal axes 44 and 46 is constant.

In accordance with the geometrical properties of elliptical conics of the second degree, it will be apparent to one of ordinary skill in the art that the cosine of half the major angle 41 is equal to the cosine of half the minor angle 42 times the cosine of the focus angle 54 (i.e. $\cos(\angle 41/2)=\cos(\angle 42/2)\cos(\angle 54)$). It will further be apparent to one of ordinary skill in the art that, in accordance with these well known geometrical properties, the constraints imposed as defined above further provide that the cosine of twice the focus angle 54 is equal to three times the cosine of the major angle 41 (i.e. $\cos(2*\angle 54)=3*\cos(\angle 41)$).

In the embodiment depicted in the Figures, the angle 17 of the triangle 20 used to constrain the circle 10 was chosen to generate a frusto-conical element 30 with the following relationship: the major angle 41 is equal to 1.618 times the minor angle 42 (i.e. $\angle 41=1.618*\angle 42=1.618*\angle 17$), however, this value is chosen for illustrative purposes and should in no way be considered limiting. As will be apparent to one of ordinary skill in the art, various other values and ratios of angles 41 and 42 are well within the scope of the present invention.

The following is a table detailing the relationship between the minor angle 42, the focus angle 54 and the major angle 41:

| ∠42 (°) | ∠42/2 (°) | cos ∠42/2 | cos ∠54 | Cos ∠41/2 | ∠41/2 | ∠41/∠42 |
|---|---|---|---|---|---|---|
| 0 | 0.00 | 1.000 | 0.707 | 0.707 | 45.00 | |
| 5 | 2.50 | 0.999 | 0.708 | 0.707 | 44.97 | 17.989 |
| 10 | 5.00 | 0.996 | 0.711 | 0.708 | 44.89 | 8.978 |
| 15 | 7.50 | 0.991 | 0.716 | 0.710 | 44.75 | 5.967 |
| 20 | 10.00 | 0.985 | 0.724 | 0.713 | 44.55 | 4.455 |
| 25 | 12.50 | 0.976 | 0.733 | 0.716 | 44.28 | 3.542 |
| 30 | 15.00 | 0.966 | 0.746 | 0.720 | 43.93 | 2.929 |
| 35 | 17.50 | 0.954 | 0.761 | 0.725 | 43.50 | 2.486 |
| 40 | 20.00 | 0.940 | 0.779 | 0.732 | 42.97 | 2.148 |
| 45 | 22.50 | 0.924 | 0.800 | 0.740 | 42.31 | 1.880 |
| 50 | 25.00 | 0.906 | 0.826 | 0.749 | 41.50 | 1.660 |
| 51.06 | 25.53 | 0.902 | 0.833 | 0.751 | 41.30 | 1.618 |
| 55 | 27.50 | 0.887 | 0.857 | 0.761 | 40.49 | 1.472 |
| 60 | 30.00 | 0.866 | 0.894 | 0.775 | 39.23 | 1.308 |
| 61 | 30.50 | 0.862 | 0.903 | 0.778 | 38.94 | 1.277 |
| 55 | 27.50 | 0.887 | 0.857 | 0.761 | 40.49 | 1.472 |
| 60 | 30.00 | 0.866 | 0.894 | 0.775 | 39.23 | 1.308 |
| 65 | 32.50 | 0.843 | 0.939 | 0.792 | 37.63 | 1.158 |
| 70 | 35.00 | 0.819 | 0.994 | 0.814 | 35.52 | 1.015 |
| 70.529 | 35.26 | 0.816 | 1.000 | 0.816 | 35.26 | 1.000 |

Figure 7:
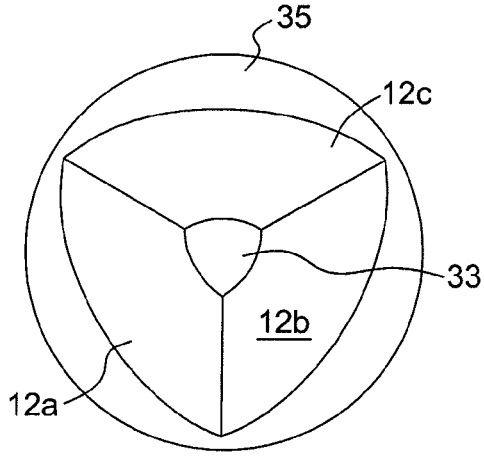
FIG. 7 is an isometric view of a spherically completed trihedron.
Figure 8A:
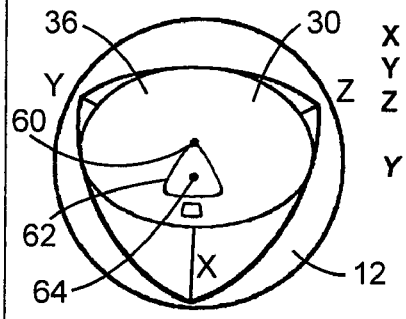
Figure 8A:
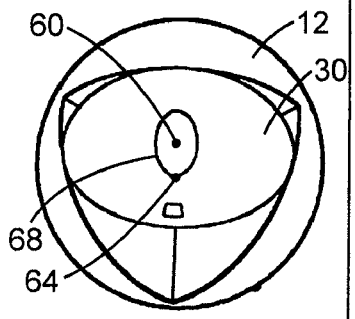
Figure 8A:
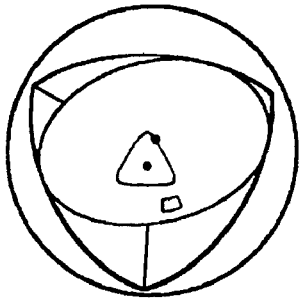
Figure 8A:
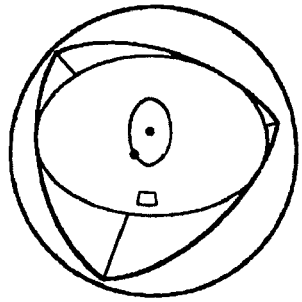
Figure 8A:
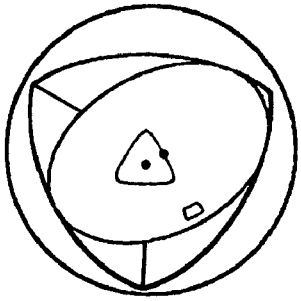
Figure 8A:
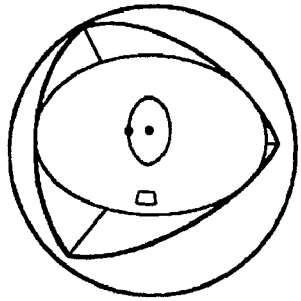
Figure 8A:
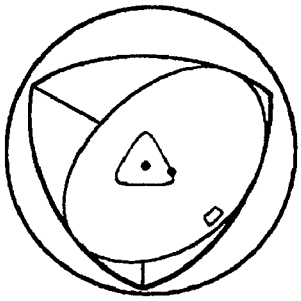
Figure 8A:
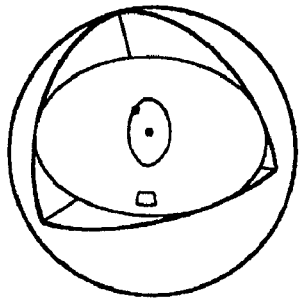
Figure 8B:
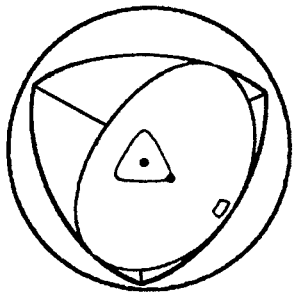
Figure 8B:
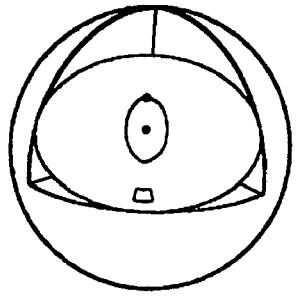
Figure 8B:
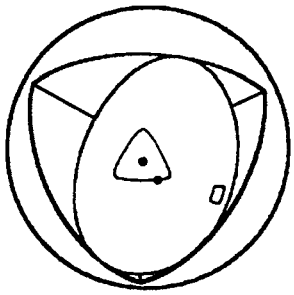
Figure 8B:
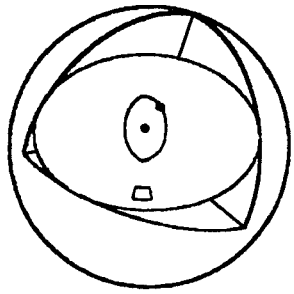
Figure 8B:
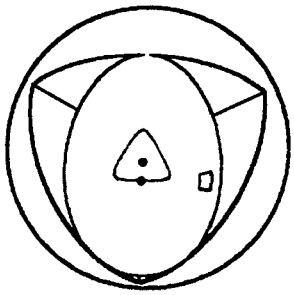
Figure 8B:
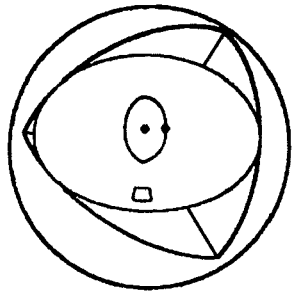
Figure 8B:
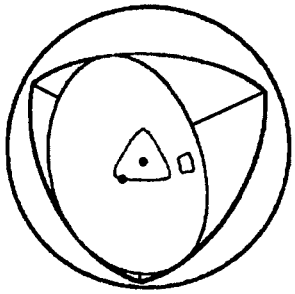
Figure 8B:
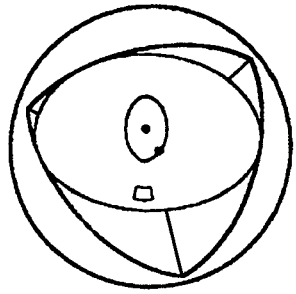
Figure 8C:
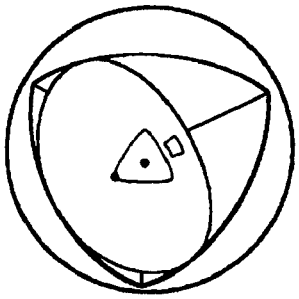
Figure 8C:
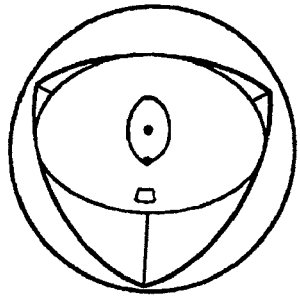
Figure 8C:
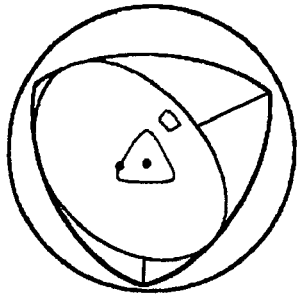
Figure 8C:
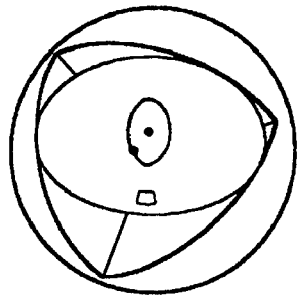
Figure 8C:
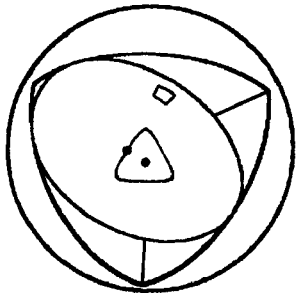
Figure 8C:
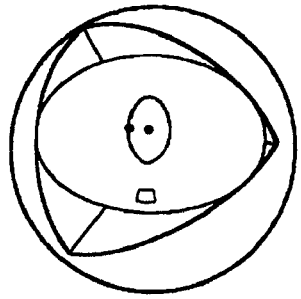
Figure 8C:
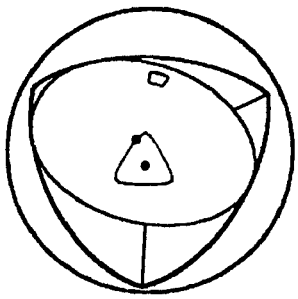
Figure 8C:
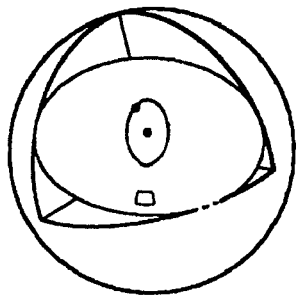
Figure 11A:
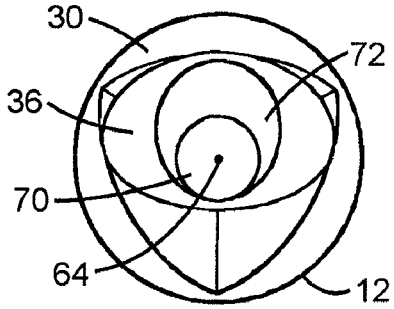
Figure 11A:
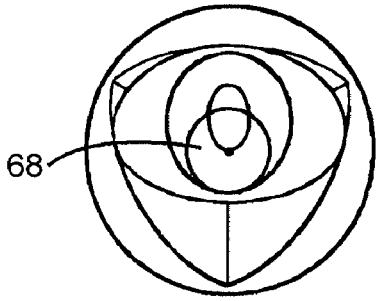
Figure 11A:
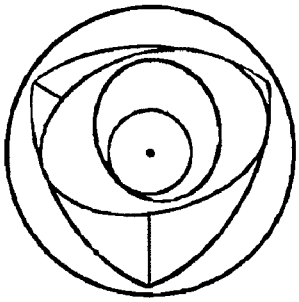
Figure 11A:
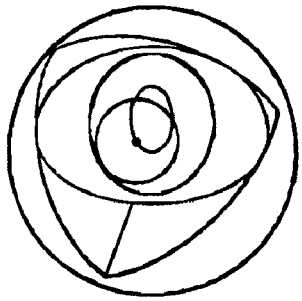
Figure 11A:
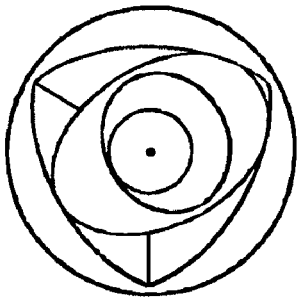
Figure 11A:
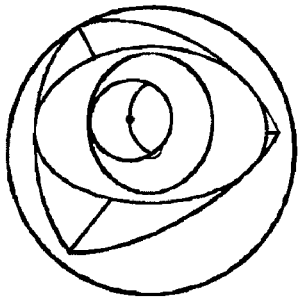
Figure 11A:
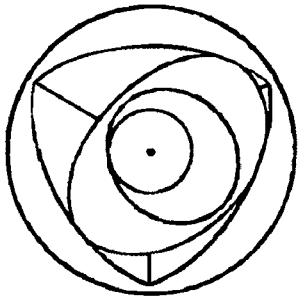
Figure 11A:
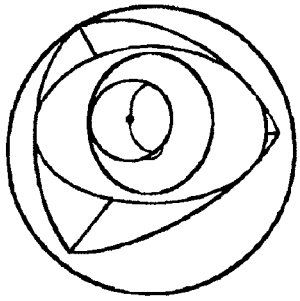
Figure 16A:
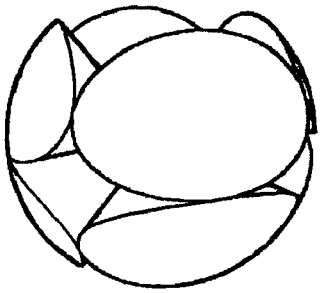
FIGS. 16A to 16L illustrate the cycle of the system of frusto-conical elements according to a preferred embodiment of the present invention.
Figure 16B:
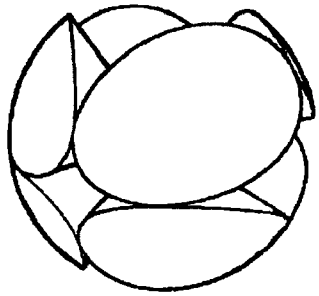
Figure 16C:
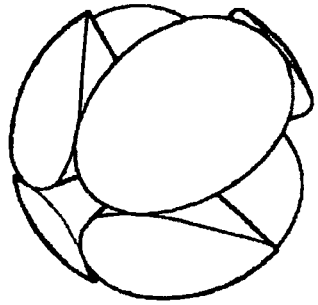
Figure 16D:
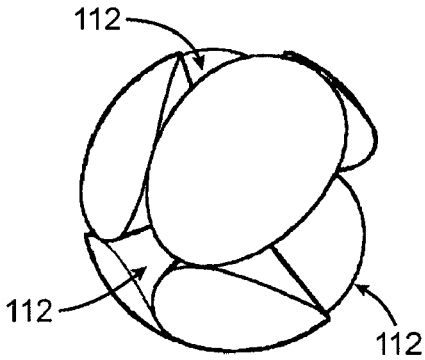
Figure 16E:
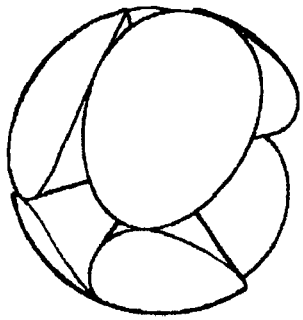
Figure 16F:
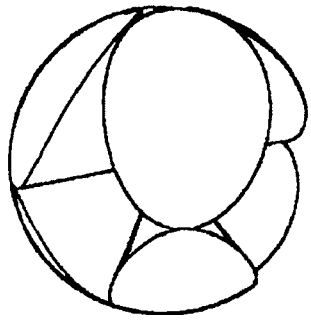
Figure 16G:
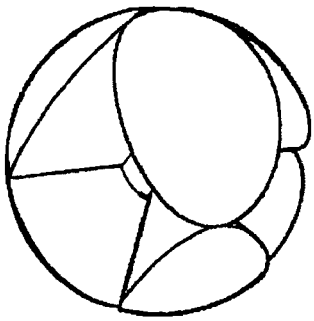
Figure 16H:
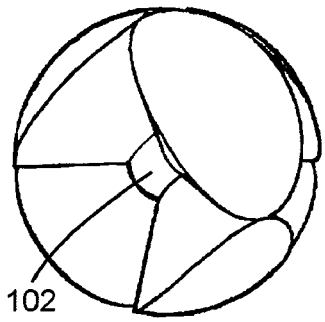
Figure 16I:
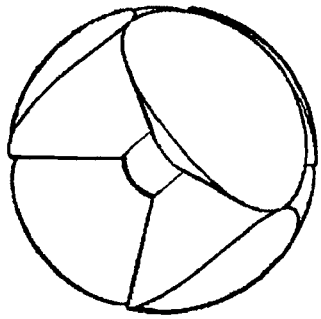
Figure 16J:
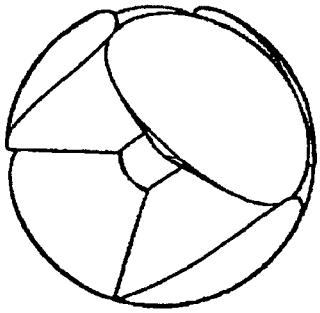
Figure 16K:
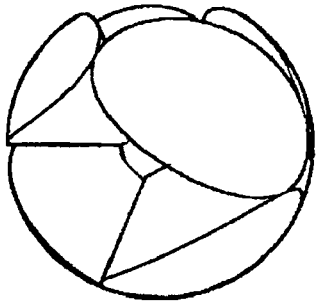
Figure 16L:
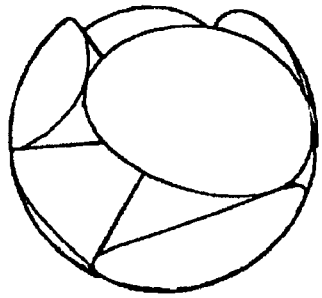

FIG. 7 illustrates an embodiment of the trihedron 12, including planes 12*a*, 12*b*, and 12*c*, which has been completed as a portion of a sphere 35 of a radius equal to that of the outer spherical surface 36 of frusto-conical element 30. In addition, an inner spherical portion 33 has been provided having a radius equal to that of the inner spherical surface 34 of frusto-conical element 30.

Frusto-Conical Element Cycle in a Trihedron

By its very construction and definition, the frusto-conical element is operable to cycle within the trihedron, although not in a pure rotation. FIG. 8 provides a table illustrating the positions of the frusto-conical element 30 and trihedron 12 during a half-cycle, from 0° to 180°. Here, the trihedron is illustrated as a quadrant of a sphere; however it will be apparent to one of ordinary skill in the art that this is for illustrative purposes only and not to be considered limiting in any way.

In FIG. 8, each row examines the frusto-conical element 30 as it cycles within the trihedron from 0° to 180°, in increments of 15° as listed in the first column.

The second column, titled "Fixed trihedron", illustrates the frusto-conical element 30 inside the spherically completed trihedron 12. While the trihedron 12 may be embodied differently, all prior discussions of the trihedron 12 remain applicable.

In each successive row, the frusto-conical element 30 is shown having rotated 15°. In order to ease visualisation, the point where central axis 52 intersects the outer spherical surface 36 has been identified as center 60. Because the cycling of the frusto-conical element is not a pure rotation, this center 60 follows a substantially triangular path 62 about trihedron center 64. As will be apparent to one of ordinary skill in the art, trihedron center 64 is the point of intersection of the axis x=y=z in the trihedron coordinates with the surface outer surface 36 of the frusto-conical element. Moreover, the entire system is viewed from this x=y=z axis.

The third column, titled "Spaces", notes the state of the volume of the spaces designated by X, Y and Z. Each row brings about a new arrangement of the cycle at each 15°. Specifically, the spaces column indicates if a space is at a minimum or maximum volume, if the space is in the process of contracting or expanding, and any symmetry between the spaces X, Y and Z.

The volume of the three spaces created between the trihedron 12 and the frusto-conical element 30 varies over the course of the cycle, however they remain associated with the limits of the trihedron 12. X is the space located below the frusto-conical element in each figure, Y is at the top left and Z is at the top right.

When a given space reaches a minimum volume it defines a space that could be filled without affecting the movement. This can have an impact on any eventual compression in the cycle.

The forth column, titled "Fixed frustum", illustrates an alternative perspective: the trihedron 12 moves about a fixed frusto-conical element 30. The view is taken along the central axis 52 of the frusto-conical element 30. In this embodiment, the frusto-conical element center point 60 remains fixed and the trihedron 12 and its center point 64 cycles thereabout following a path 68. This path 68, while appearing elliptical, may actually be not strictly elliptical. As such, the path 68 will be referred to as the pseudo-elliptical path 68.

At 180°, the frusto-conical element 30 has returned to its original position even though it has only completed half a revolution (i.e. the major side 43 that started off at 0° touching the plane, is now opposite the plane). As will be apparent to one of ordinary skill in the art, the second half of the cycle, 180° to 360°, is therefore identical to the first half.

The position of the frusto-conical element 30 within the trihedron 12 is repeated every 60°. At 0°, 6° and 120°, spaces X, Y and Z are at their maximums, respectively. At 30°, 90° and 150°, spaces Z, X and Y are at their minimums, respectively.

Rolling of the Frusto-Conical Element

The path of the trihedron center point 64 about a fixed frusto-conical element 30 is described by the pseudo-elliptical path 68. As such, the axis of a trihedron 12 (i.e. the line x=y=z) sweeps out an elliptical cone passing through that pseudo-elliptical path 68.

To enhance the motion of the frusto-conical element 30, a circular cone 70, illustrated in FIG. 9, is provided which is operable to rotate about the axis x=y=z of the trihedron 12. Because the axis of this cone 70 passes through the trihedron center point 64 and is operable to rotate about the trihedron axis x=y=z, the cone 70 will follow the pseudo-elliptical path 68 with respect to a fixed frusto-conical element 30.

To accommodate the presence of the cone 70, an pseudo-elliptical channel 72 in the frusto-conical element 30 is provided equaling the sweep of the volume of the cone 70 as it follows the path 68, and as illustrated in FIG. 10, thereby allowing the cone 70 to rotate within the frusto-conical element 30, or from another frame of reference allowing the frusto-conical element 30 to rotate about the cone 70. The cone 70 has an outer conical surface 136 which engages the elliptical channel 72.

FIG. 11 provides a table similar to that in FIG. 8 which gives the positions of the frusto-conical element 30, now including the pseudo-elliptical channel, or void 72 for engaging the cone 70, and trihedron 12, now including the cone 70.

The angle at the vertex of the cone 70 is preferably chosen such that the interior space remains closed. Preferably, the cone 70 and boundary of the void area 72 remain in contact at all times. The smaller the angle of cone 70, the smaller the cone 70 and the more turns it makes within the frusto-conical element 30.

As will be apparent to one of ordinary skill in the art, the addition of revolution cone 70 and the corresponding void area in the frusto-conical element 30, as illustrated in FIG. 11, does not alter the cycle of the frusto-conical element 30 and trihedron 12 as previously described. This addition can, however, be advantageously used to simply strengthen the mechanism, or for other uses to be described in further detail below.

Change in Volume of Spaces X, Y and Z

FIG. 12 graphs the variation in volume of the spaces X, Y and Z during the frusto-conical element cycle illustrated in the previous Figures. The sinusoidal-like curves 80, 82 and 84 correspond respectively to the changes in volume of spaces X, Y and Z.

The sum of the three curves 80, 82 and 84 at any point in the cycle is substantially constant. As such, not only is there no dead time but this consistency enables the operation of mechanisms with a constant intensity.

Also, the above-noted curves correspond substantially with the waveforms of a three-phase electric power system. As such, the frusto-conical element 30 and trihedron 12, or indeed the system of frusto-conical elements described in detail further below, coupled to an appropriate rotor and stator could be used to generate a three-phase current.

As seen in FIGS. 8 and 11, the volumes of spaces X, Y and Z created by the frusto-conical element 30 within the frusto-conical element 12 are at their minimums at 90°, 150° and 30°, respectively. These minimum volumes can be utilised as part of the cycle, or rather can be modified (enlarged, reduced, or eliminated entirely) by opening up, or filling in those areas of the frusto-conical element 12 as desired for a particular embodiment.

Moreover, because no part of the frusto-conical element 30 will enter into these minimum spaces defined by X, Y and Z at 90°, 150° and 30°, respectively, these areas could be utilised to actively control and modify the volumes of X, Y and Z over the course of the entire cycle. For example, a movable wall actuated by pistons or the like may be provided to open and close portions of the minimum volume areas during the cycle. Such an active control can be utilised to further optimise the characteristics of the change in volume of spaces X, Y and Z, as illustrated in FIG. 12, and the operation of the frusto-conical element 30 within the trihedron 12.

Concentric Frusto-Conical Elements

Figure 27A:
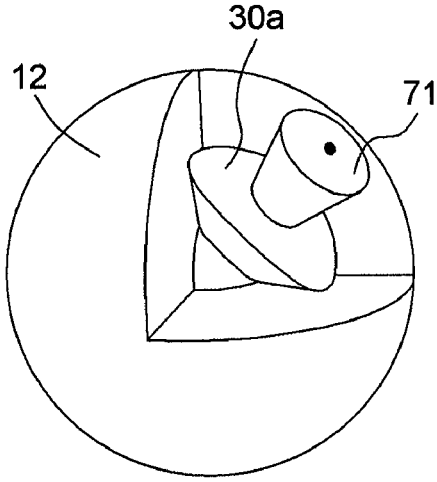
FIGS. 27A to 27F are isometric views of a trihedron with concentric inner and outer frusto-conical elements and an outer shell according to a preferred embodiment of the present invention.

In an alternative embodiment, inner and outer concentric frusto-conical elements 30*a* and 30*b* can be provided in a trihedron 12. FIG. 27A illustrates an inner frusto-conical element 30*a* within a trihedron 12 which is operable to cycle on the inner spherical portion 33. Further provided is a post 71 projecting along the axis 52 of the frusto-conical element 30*a*. It is to be noted that post 71 projecting from the frusto-conical element 30*a* is not to be confused with the cone 70 projecting from the spherically completed trihedron 12 of FIGS. 9, 11 and 16.

Figure 27B:
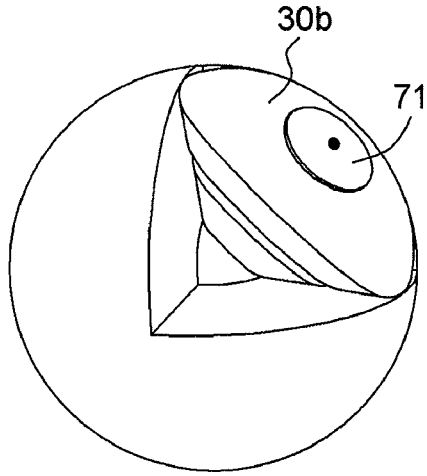

Additionally provided in FIG. 27B is an outer frusto-conical element 30*b* which is concentric to the inner frusto-conical element 30*a*, and is similarly aligned about post 71. The radius of the trihedron 12 is substantially equal to the outer radius of outer frusto-conical element 30*b*.

Figure 27C:
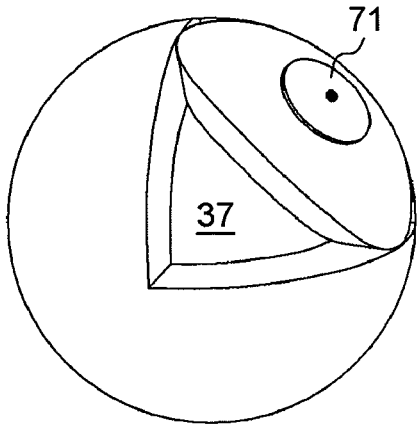

Additionally provided in FIG. 27C is a shell 37 provided between the concentric inner and outer frusto-conical elements 30*a* and 30*b*. The inner and outer frusto-conical elements 30*a* and 30*b* are able to cycle within the trihedron 12, however by dividing the frusto-conical element into inner and outer frusto-conical elements 30*a* and 30*b* divided by the shell 37, two distinct sets of spaces X, Y and Z are created.

Figure 27D:
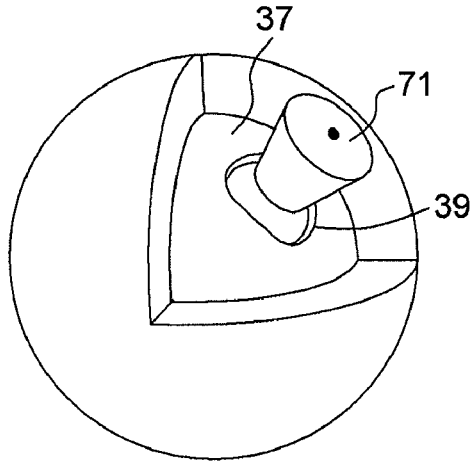
Figure 27E:
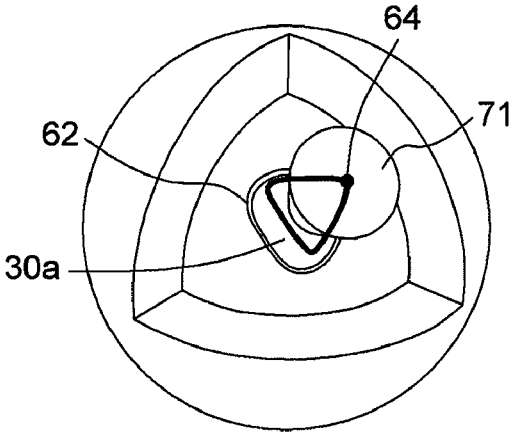

FIGS. 27D and 27E illustrated the inner frusto-conical element 30*a* and the shell 37 having removed the outer frusto-conical element 30*b*. A substantially triangular slot 39 is provided in the shell 37 for receiving the post 71. As the frusto-conical elements 30*a* and 30*b*, and the post 71 cycles within the trihedron 12, their common axis 52, marked here at center 64, follows a triangular path as discussed previously regarding FIG. 8. The corresponding triangular shape of slot 39 is provided to ensure an unencumbered movement of the post 71 as it cycles.

Figure 27F:
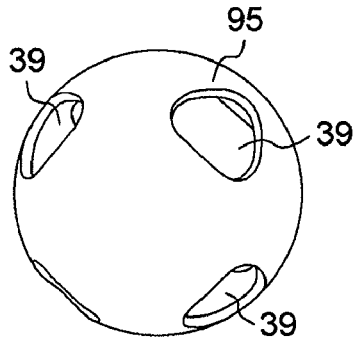

For its part, FIG. 27F illustrates an outer shell which can enclose a plurality of inner and outer frusto-conical elements 30*a* and 30*b*, as will be discussed in further detail below.

Introduction of a Fluid

In order to make use of the potential of the spaces X, Y and Z created, it is desirable to introduce therein a fluid. This can be an incompressible liquid for a hydraulic system, a gas for use in a pneumatic system, a compressor or a motor, although use of other fluids is within the scope of the present invention. In each case however, it is necessary to find openings to allow the entry and exit of a fluid at pre-determined times.

In the present embodiment, the frusto-conical element 30 and the trihedron 12 share a common vertex/origin 18. As their motions are different, a spherical piece can be provided enclosing the two. This is arranged to avoid additional mechanisms with additional pieces having their own movement uniquely dedicated, such as cams and followers.

Depending on the application, an approach in determining the appropriate openings is to study the cycle and determine the instant at which the spaces must be closed. It is sufficient to retain only the part of the surface required in order to assure a properly closed space. Once this exercise is completed, those parts of the surface that can remain open are the openings needed. It will be apparent to one of ordinary skill in the art that it is preferable not to allow a space to be in communication with both and input and output at the same point in the cycle. Other techniques are, of course, also available.

The openings could be located either on interior sphere adjacent to the inner spherical surface 34, exterior sphere adjacent to the outer spherical surface 36, or a combination thereof. For example, one could provide input openings on the center sphere and outer orifices on the exterior sphere.

Applications

The combination of the trihedron 12 and the frusto-conical element 30 is applicable to various applications. For example, for generating the rotation of a shaft associated with a frusto-conical element 30. The rotation could be used in a turbine for use of the combined volume of the enclosed spaces; powered by a fluid current; a motor powered by compressed gas which makes use of the expansion period of each space individually, the periods of contraction in this case being non-functional; an internal combustion engine which uses the change in volume of the spaces over the course of the combustion cycle; either four-stroke (intake, compression, power, exhaust) or two-stroke (intake/compression, power/exhaust); or generating rotation from the frusto-conical element 30 for electrical power generation;

Additionally, the combination could be used for attaching the frusto-conical element 30 to a shaft powered by an exterior source of energy. Such an attachment could be used for powering a hydraulic circuit; compressing a gas; pumping a fluid; or producing electricity.

Further still, the combination could be used as a source of electricity for powering hydraulic circuit uniformly; compressing a gas; or pumping a fluid.

A characteristic common to the majority of these possible applications is that they are reversible. As such, similar mechanisms to be used for example to compress a gas by a rotary motion and conversely can be made to create rotary motion from a compressed gas.

Pump (or Turbine)

To determine the proper arrangement of openings for a pump (or turbine), the following technique can be used.

The frusto-conical element 30 is covered by a first cover element 90, as seen in FIG. 13, which slides on the spherical exterior of trihedron 12 and provides a complete enclosure of the spaces during their maximum and minimum volumes via one of lateral extensions 91. The second cover portion 92 is provided to define the openings 96 in combination with first cover element 90. This is limited by the edges of the trihedron 12. The combination of the first and second cover portions 90 and 92 form a cover piece 94 which is retained to the frusto-conical element 30 and operable to rotate therewith. Four openings 96*a*, 96*b*, 96*c* and 96*d* are thereby defined. Openings 96*a* and 96*c* are dubbed input openings, while openings 96*b* and 96*d* are dubbed output openings, as will be seen in further detail below. It will be apparent to one of ordinary skill in the art that other techniques are also within the scope of the invention.

FIG. 14 provides a table illustrating the positions of the cover 94 with regard to the three spaces X, Y and Z from 0° to 90° of the cycle.

The X, Y and Z columns represent views of the trihedron 12, frusto-conical element 30 and cover 94 from different points of view. More specifically, the X, Y and Z views are centered on each of the X, Y and Z spaces. These points of view correspond to the views of the spherically completed trihedron 12 shown in FIG. 7. As with the previously discussed table, each row illustrates a different point in the cycle, with the addition here of the different points of view.

Similarly, an analysis of the state of each volume X, Y and Z is noted. Further noted, is whether the opening aligned with a given space is one of input openings 96*a* and 96*c*, or one of output openings 96*b* or 96*d*.

It is noteworthy that at every position in the cycle at most three openings 96 are active (Y open into of spaces X and Z) but never four. Moreover, at the maxima and minima of a given space, that space is closed and only the two remaining spaces are open.

When three openings 96 are active, two of the spaces are either expanding or contracting while the remaining space is either contracting or expanding. The two spaces that are undergoing the same type of volume change are also both facing the same type of opening—input or output. In the present embodiment, spaces which are contracting are aligned with one of output openings 96*b* and 96*d*, while spaces that are expanding are aligned with one of the input openings 96*a* and 96*c*. These openings 96 can therefore be used, for example, in a fluid circuit, wherein the input openings 96*a* and 96*c* receive a fluid input into the circuit and the output openings 96*b* and 96*d* return the exiting fluid into the circuit.

As will be apparent to one of ordinary skill in the art, forcing a fluid flow into one of the spaces will turn to the frusto-conical element. The frusto-conical element 30 turns in the opposite direction if the fluid flow is reversed. Conversely, forcing the rotation of the frusto-conical element 30 creates a circulation of the fluid within the trihedron 12. Here again, this can work in either directions. In addition, blocking the fluid flow blocks the rotation of the frusto-conical element 30 and conversely blocking the movement of the frusto-conical element 30 prevents circulation of the fluid within the trihedron. What's more, the intensity of the cycle is preferably invariable and the form of the openings can be modified.

Pressurized Gas Driven Motor and Compressor

This embodiment preferably uses a different set of openings to that of the turbine/pump. The input of a compressed gas occurs when a given space is at its smallest so as to optimally provide for its expansion. The space must remain closed during its entire expansion and open at its maximum (or thereabouts) and remain opened during the exhausting of the residual gas.

Once the minimum value of the space is reached, pressurized gas may once again be input.

These considerations produce different openings which can be found by the previous procedure. The result of the four openings will general statements regarding the input openings 96*a* and 96*c*, and the output openings 96*b* and 96*d*. The two output openings have the same format as that on the turbine described above however the input openings will be smaller and will be located the closer to the small radius of curvature of the frusto-conical element.

Internal Combustion Engine

Given that in a complete cycle, each space undergoes two expansions and two contractions, it is applicable to the cycle to a four-stroke internal combustion engine.

System of Eight Frusto-Conical Elements

All of the above-noted functionalities of the frusto-conical element 30 placed within a trihedron 12, and the variation in the spaces created therein, may be similarly be extended by combining a plurality of frusto-conical elements 30 sharing the same vertex. While this combination is possible with frusto-conical elements of varying sizes, in the preferred embodiment a system of eight frusto-conical elements constrained between two concentric spherical shells will be described.

With reference now to FIG. 15, the original trihedron 12 formed of three intersecting planes 12*a*, 12*b* and 12*c* is illustrated with eight frusto-conical elements placed in each octant formed by the trihedron 12, forming a system of frusto-conical elements 100. The frusto-conical elements 30 are disposed and aligned as mirror images about the three planes of the trihedron 12 such that each the line of contact between the lateral surface 32 and a given plane 12 is shared by the adjacent frusto-conical element 30 on the opposite side of that plane. The alignment of each frusto-conical element 30 with the planes 12*a*, 12*b* and 12*c*, and the symmetries therein continue to exist within the system 100 even if the frusto-conical elements 30 are interacting with each other rather than a single frusto-conical element 30 interacting with the walls of the trihedron 12.

A first frusto-conical element 30*a* is provided in a first octant of the trihedron 12. Adjacent thereto is a second frusto-conical element 30*b* substantially behind the first frusto-conical element 30*a*, and a third frusto-conical element 30*c* substantially below the first frusto-conical element 30*a*. The first and second frusto-conical elements 30*a* and 30*b* each engage opposite sides of plane 12*a* along 104*a*. The first and third frusto-conical elements 30*a* and 30*c* each engage opposite sides of plane 12*b* along 104*b*. A fourth frusto-conical element 30*d* (not shown) similarly engages plane 12*c* along the same line as the first frusto-conical element 30*a*.

Similarly, each frusto-conical element 30 of the system 100 engages three planes of the trihedron 12 along the same lines as the three frusto-conical elements 30 immediately adjacent. As such, when viewed without the trihedron 12, the frusto-conical elements 30 are operable to directly engage one another.

As seen in FIGS. 16A to 16L, which illustrate a synchronised rolling of the system 100 in steps of 15°, the symmetries about each plane of the trihedron 12 persist as the frusto-conical elements are displaced.

Aligned as such about a common vertex, the frusto-conical elements 30 are provided around a common spherical central shell 102 having a radius equal to that of the inner spherical surface 34. This is similar to the inner spherical portion 33 of the spherically completed trihedron 12. As such, each frusto-conical element 30 is operable to cycle about the common central sphere 102 as described above, however now each frusto-conical element 30 will engage its three adjacent frusto-conical elements 30 instead of three planes of trihedron 12.

Rolling of the Elements

The eight frusto-conical elements 30 of the system 100 are constrained such that the first spherical surface 34 of each element 30 engages the central sphere 102, and each element 30 remains in linear contact along its lateral surface 32 with three adjacent elements 30. As will be apparent, alternative embodiments wherein, for example, elements of a different size are used, or the system comprises less elements 30 may result in some elements 30 being in contact with less or more adjacent elements 30.

Constrained as such, the eight frusto-conical elements 30 are operable to roll about one another while on the central sphere 102 in a synchronised and cyclical manner. Each frusto-conical element 30 is always in contact with the three frusto-conical elements 30 adjacent. Furthermore, as previously noted, this cycling is an extension of the frusto-conical element 30/trihedron 12 cycle described above because the frusto-conical elements 30 are aligned such that their three lines of contact each other correspond with those they would make with the trihedron 12 (for example, lines 24*a* to 24*c* of FIG. 4). The main difference between the cycle of the system 100 and that of a frusto-conical element 30 and trihedron 12 is that that spaces X, Y and Z of individual frusto-conical elements 30 now combine to form a plurality of chambers 112, in this case six, which are each a combination of four such spaces and therefore four times as large. Input and output means, which will be discussed in further detail below, are provided for allowing the fluid into and out of the chambers.

In order to maintain the necessary alignment herein described, constraining means are provided which will be discussed in further detail below.

Input and Output

Figure 17A:
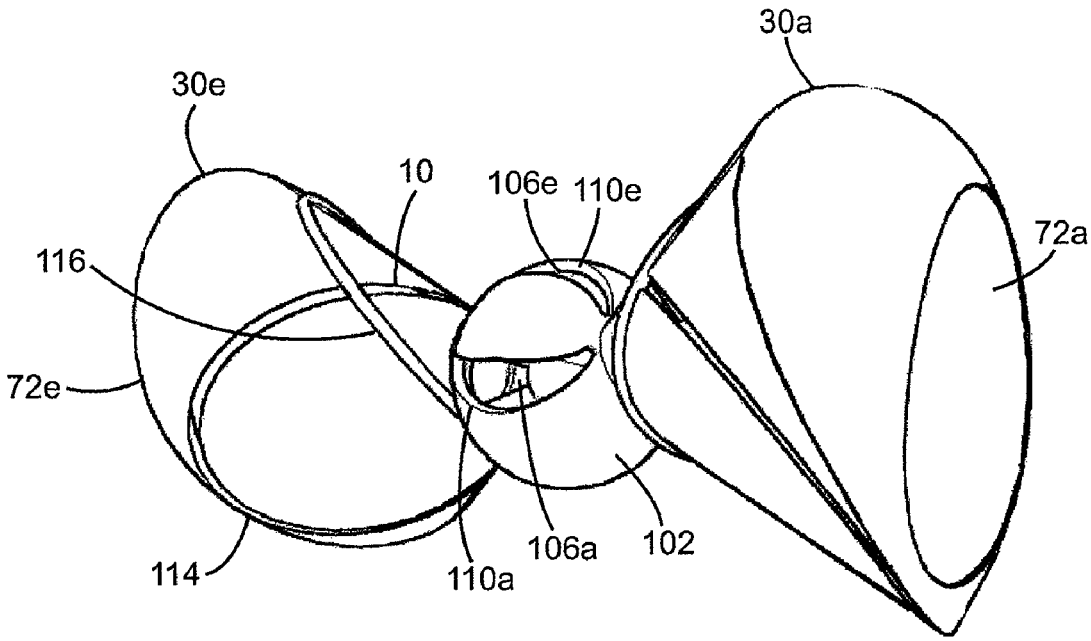
FIGS. 17A and 17B are isometric views of a system axis according to a preferred embodiment of the present invention.
Figure 17B:
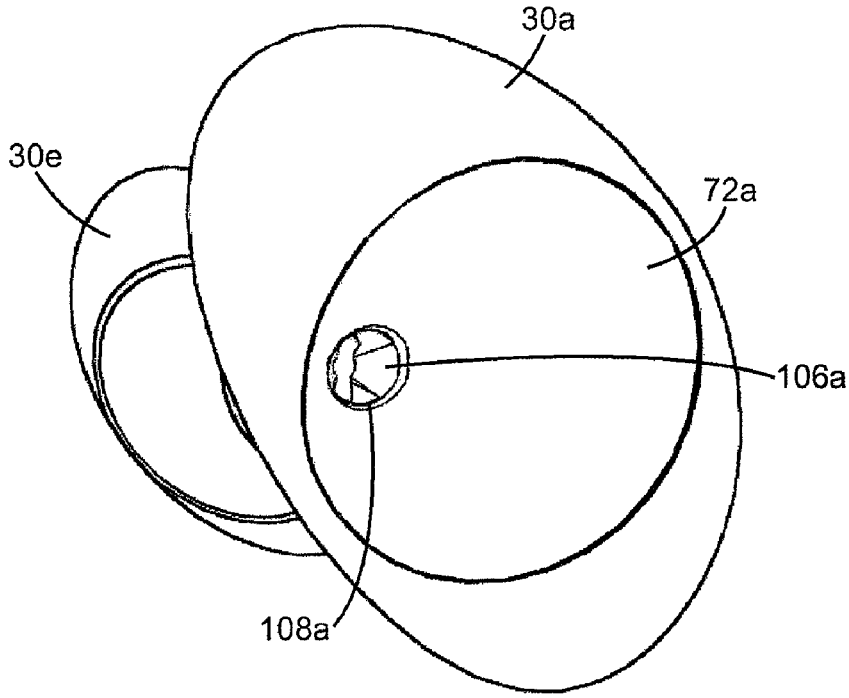

With reference now to FIGS. 17A and 17B, two of the frusto-conical elements 30 have a particular role in the system 100. In the embodiment illustrated herein, these two elements 30 are the first and fifth frusto-conical elements 30*a* and 30*e*, hereinafter referred to as the input frusto-conical element 30*a* and the output frusto-conical element 30*e*, and are fixed to the central sphere 102. These two are illustrated in FIGS. 17A and 17B, without the other six frusto-conical elements 30*b*, 30*c*, 30*d*, 30*f*, 30*g* and 30*h* of system 100. Located diametrically opposite one another, the input and output frusto-conical elements 30*a* and 30*e* are linked by the central sphere 102 and comprise the axis of the system 100. The remaining six frusto-conical elements 30 are divided into two groups: frusto-conical elements 30*b*, 30*c* and 30*d* which cycle about input frusto-conical element 30*a*; and frusto-conical elements 30*f*, 30*g* and 30*h* which cycle about output frusto-conical element 30*e*. Two groups of frusto-conical elements will hereinafter be referred to also as secondary input frusto-conical elements 30*b*, 30*c* and 30*d* and secondary output frusto-conical elements 30*f*, 30*g* and 30*h*. It is to be noted, however, that this grouping and designation of input and output frusto-conical elements is purely exemplary in nature as other arrangements exits, such as an input and output being provided on the same side of the system 100, and are within the scope of the present invention.

The input and output frusto-conical elements 30*a* and 30*e* are provided with input and output voids, or channels 72*a* and 72*e* which communicate with respective portions of the inside of the central sphere 102 in order to form part of the input and output means that enable the flow of fluid within the system 100. Like the pseudo-elliptical channel 72, the input and output channels 72*a* and 72*e* are preferably based on the same pseudo-elliptical path 68 illustrated in FIG. 8. While this pseudo-elliptical shape is not strictly necessary for achieving their primary purpose, i.e. that of inputting and outputting fluid, it does advantageously allow for the further engagement with an external component satisfying the same geometric criteria as the cone 70. Furthermore, it is to be noted that while the input and output elements 30*a* and 30*e* are illustrated herein as opposite one another with respect to the central sphere 102, and fixed thereto, for the purposes of the input and output means the designated elements 30 could be otherwise spatially positioned and/or fixed.

Figure 18A:
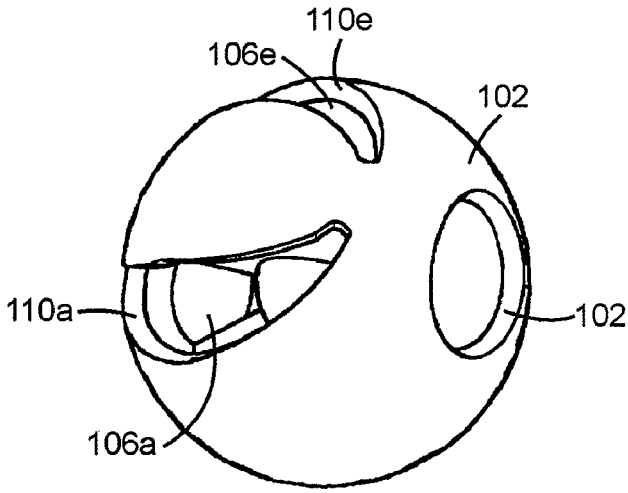
FIGS. 18A and 18B are isometric views of a central sphere and internal chambers according to a preferred embodiment of the present invention.
Figure 18B:
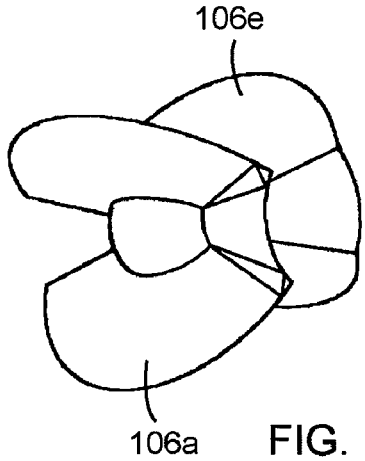

The input and output channels 72*a* and 72*e* communicate with respective first and second internal channels 106*a* and 106*e* which are located within the central sphere 102. With additional reference to FIGS. 18A and 18B, which illustrate the central sphere 102 and channels 106, respectively, a fluid is operable to flow from the input channel 72*a* and pass through an axial input 108*a* into the central sphere 102 and flow therethrough. The first internal channel 106*a* then directs the fluid flow out through radial openings 110*a* (only one of which is visible in FIGS. 17 and 18A, although another is preferably provided diametrically opposite) and into one of the chambers 112. The central sphere 102 further comprises an axial output 108*e* in fluid communication with the second channel 106*e* which is diametrically opposed to axial input 108*a*, In addition, a pair of radial openings 110*e* is provided in communication with output chamber 106*e*.

Chambers

Everything that has been described herein with regard to the frusto-conical element 30 is still applicable to the system 100. Due to the symmetry of the system, the chambers 112 created are simply four times as large due to the interaction of four frusto-conical elements 30 in creating the spaces. While the trihedron 12 is no longer present, an externally anchored component corresponding to the revolution cone can be used to constrain movement of the frusto-conical element 30, as noted. The chambers can be advantageously made isolated from one another with proper sealing means.

Figure 19:
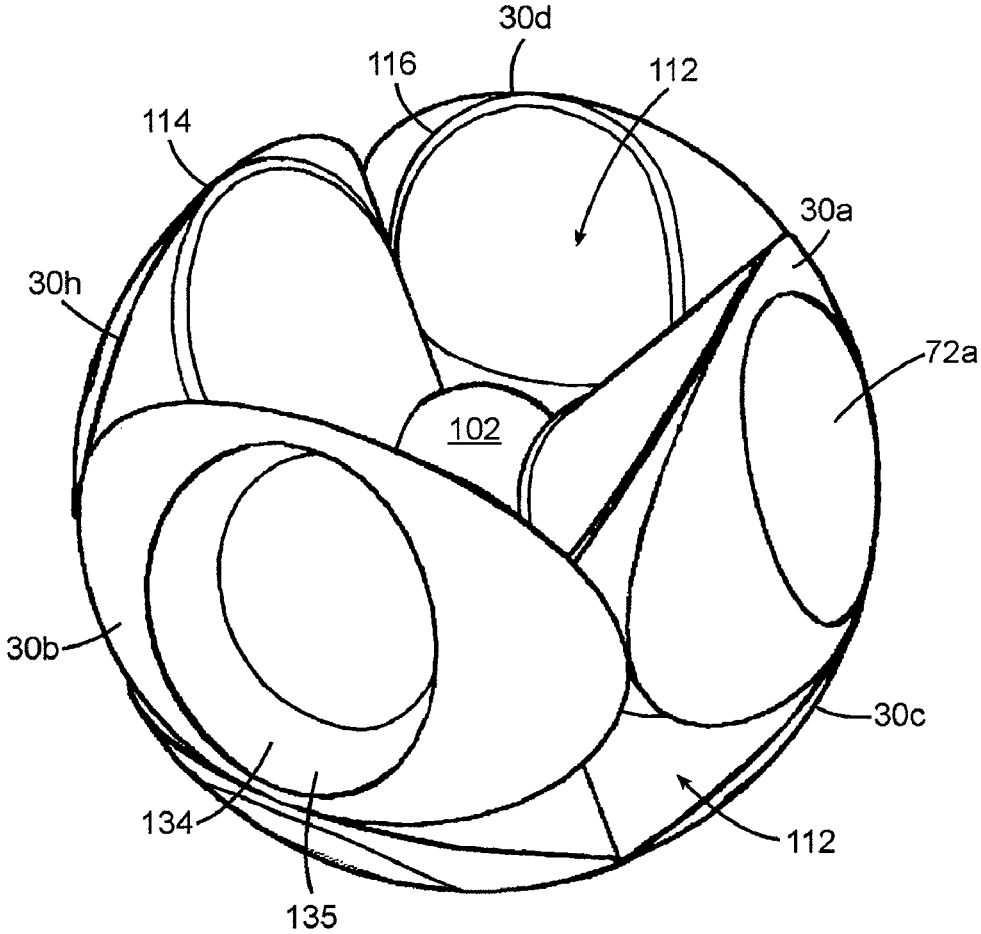
FIG. 19 is an isometric view of a system of eight frusto-conical elements according to a preferred embodiment of the present invention.
Figure 20A:
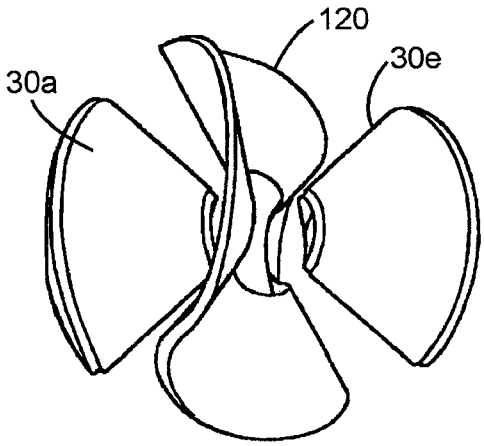
FIGS. 20A to 20E are top and side views of frusto-conical elements and a conical belt according to a preferred embodiment of the present invention.
Figure 20B:
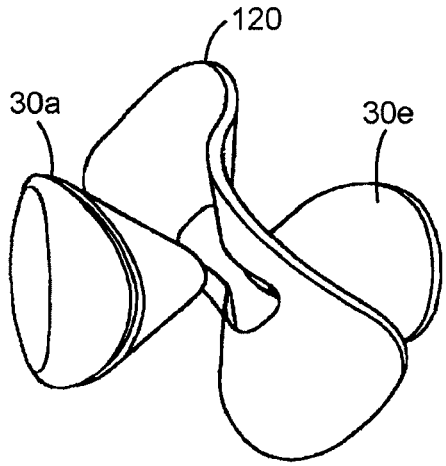
Figure 20C:
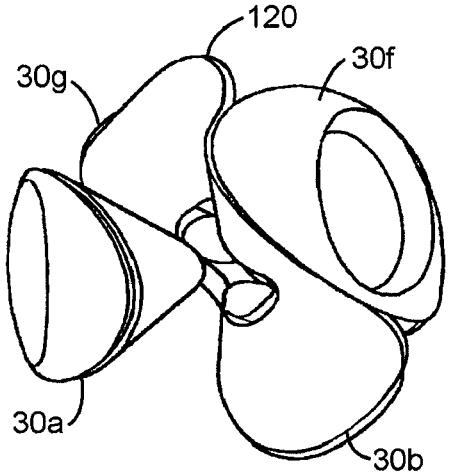
Figure 20D:
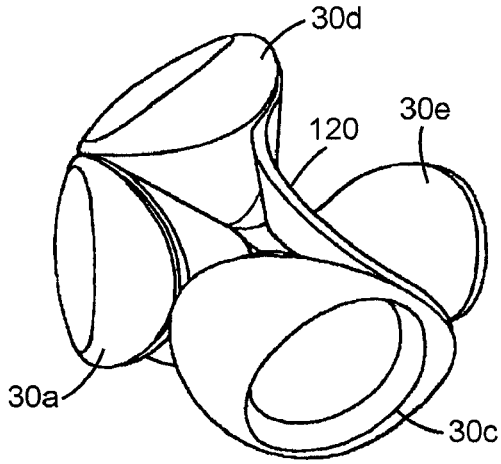
Figure 20E:
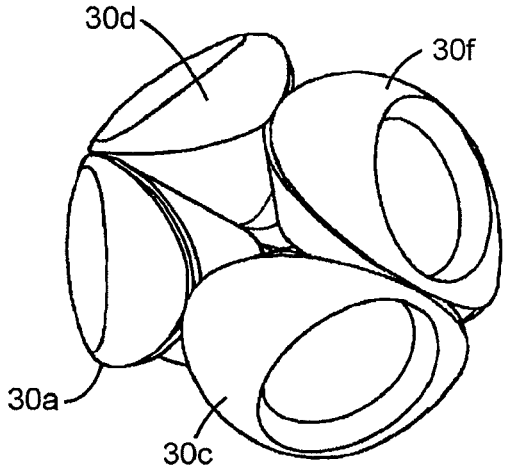

With additional reference to FIG. 19, the chambers 112 can be divided into two groups in a manner similar to that of the frusto-conical elements 30—i.e. input frusto-conical element 30*a* and secondary input frusto-conical elements 30*b*, 30*c* and 30*d*; output frusto-conical element 30*e* and secondary output frusto-conical elements 30*f*, 30*g* and 30*h*

When viewed from the point of view of a fixed axis, the two groups of three chambers 112 revolve about each of the input and output frusto-conical elements 30*a* and 30*e*. For example, the chamber 112 of FIG. 22 formed between the input element 30*a*, the secondary input elements 30*b* and 30*d*, and secondary output element 30*h* cycles around the input frusto-conical element 30*a* along with secondary input elements 30*b* and 30*d*. Similar chambers 112 are formed between input frusto-conical element 30*a*, secondary input elements 30*b* and 30*c*, and secondary output element 30*f*; and input element 30*a*, secondary input elements 30*c* and 30*d*, and secondary output 30*g*.

Diametrically opposed to each of the afore-mentioned chambers 112 are corresponding chambers 112 associated with the output element 30*e*. Each of these chambers 112 are formed by a different combination of the output element 30*e*, two the secondary output elements 30*f*, 30*g* and 30*h*, and one of secondary input elements 30*b*, 30*c* and 30*d*.

During rolling of the system 100, the three chambers 112 associated with the input side of the system 100 contract and expand in the same way as the chambers associated with the output side and, as noted, still obey the general principles described with regard to the initial frusto-conical element 30 within trihedron 12. Moreover, it is to be noted that because these six chambers exist as two relatively individual sets of three chambers different roles can be assigned to each set. For example, one side of the system 100 can be used as a turbine powered by hydraulic fluid, as discussed above, and the other as a pump driven by the supply of hydraulic fluid. In addition, it will be apparent that the an embodiment wherein only one set of chambers 112 are desired, thereby eliminating the need for the element 30*e* altogether, is within the scope of the present invention.

The inlet and outlet of a fluid in the system 100 can be done entirely with external openings 96. In this embodiment, however, the chambers 112 associated with the input side and those associated with the output side remain cut off from one another. It is the openings in the central shell 102, i.e. radial openings 110 which allow transmission of a fluid from one of the chambers 112 associated with the input side to a corresponding output-side chamber 112.

Figure 23A:
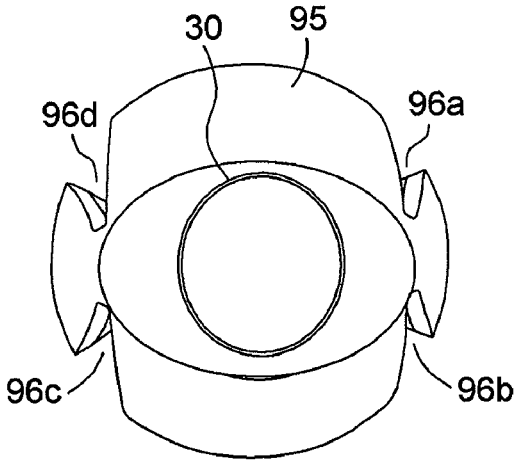
FIGS. 23A and 23B are a front and side angle views, respectively, of a system cover for a pump according to a preferred embodiment of the present invention.
Figure 23B:
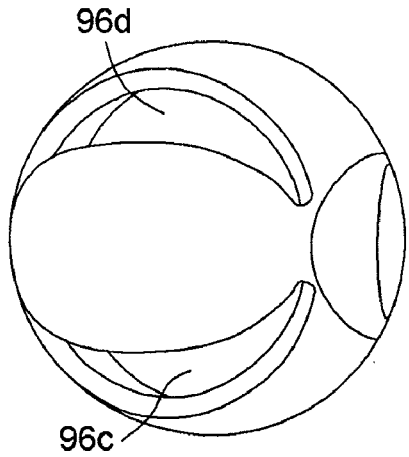

With reference to FIGS. 23A and 23B, a spherical outer shell 95 is illustrated for enclosing the central shell 102 and the frusto-conical elements 30. The radius of the outer shell 95 matches the radius of the outer surface 36, and the central and outer shells 102 and 95 are concentric. As shown, the outer shell 95 is designed specifically to accommodate the needs of a pump. This embodiment provides input openings 96*a* and 96*c* and output openings 96*b* and 96*d*, each operable to feed the chambers 112 of both groups of frusto-conical elements. Rather than entering through an input opening 96 in the outer shell 95 which is aligned with the input channel 72*a*, as discussed in reference to FIGS. 17A, 17B and 19, a fluid can be input and output from the chambers 112 directly through openings in the outer shell 95. This approach is similar to that discussed regarding the single frusto-conical element 30 within the spherically completed trihedron of FIG. 14.

In use, for example, when a given chamber 112 is aligned with the input opening 96*a*, is will receive a fluid. This reception will occur as the chamber 112 is aligned with the opening 96*a* and can therefore be set for a pre-determined portion of its cyclical change in volume. As the given chamber 112 expands and contracts, it will travel around the system 100 and once aligned with the output opening 96*d*, the fluid will be released over a similarly pre-determined portion of the chamber's 112 cyclical change in volume. Preferably, the pre-determined portion includes the point at which the chamber 112 reaches a minimum volume.

In this embodiment, openings 96 in the central sphere 102 are not required, although it will be noted that these input and output openings 96*a* to 96*d* are similar in size and shape to the radial openings 106 of the central sphere 102, and indeed could be provided exclusively therein as well. As previously noted, fluid communication to the chambers 112 of the system 100 can be achieved from the outside, or inside. As such, these two sets of openings are provided with similar shapes as they are provided to fulfill similar roles.

Similarly, the embodiments provided in FIGS. 24A and 24B, and 25A and 25B comprise input openings which are operable to feed chambers 112 from both groups of frusto-conical elements 112. This utilisation of both groups of frusto-conical elements 30 and the chambers 112 provides and even operation due to the combined and coordinated operation of both, in some cases independent, halves of the system 100. In such an embodiment, the labels of "input" and output" for the groups of chambers is less appropriate. Rather, "first" and "second" groups will henceforth be used.

Figure 24A:
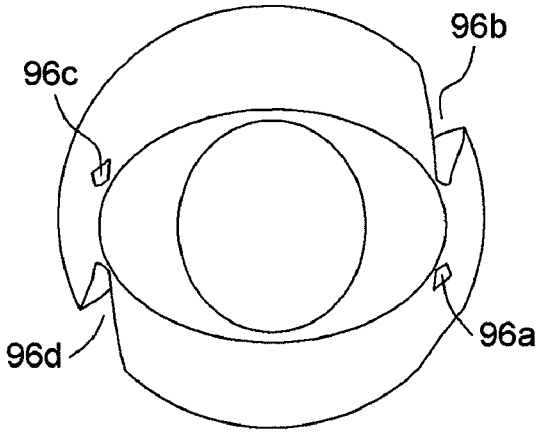
FIGS. 24A and 24B are a front and side angle views, respectively of a system cover for a pressurised gas driven motor or compressor according to a preferred embodiment of the present invention.
Figure 24B:
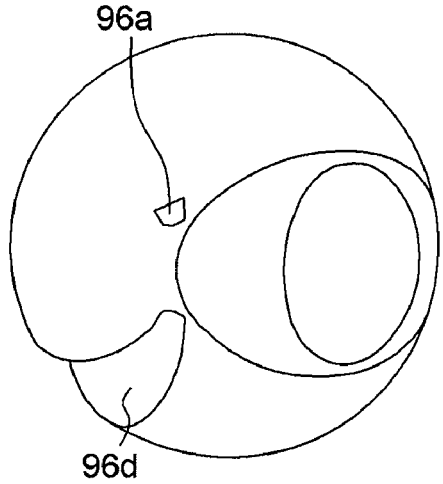

With specific reference to FIGS. 24A and 2413, a cover is shown specifically designed for a pressurized gas driven motor, or compressor. In this embodiment, input openings 96*a* and 96*c* are open only for the first 8 degrees of the cycle in order to allow the pressurized gas to expand the space 112, while the output openings 96*b* and 96*d* are similarly dimensioned.

Figure 25A:
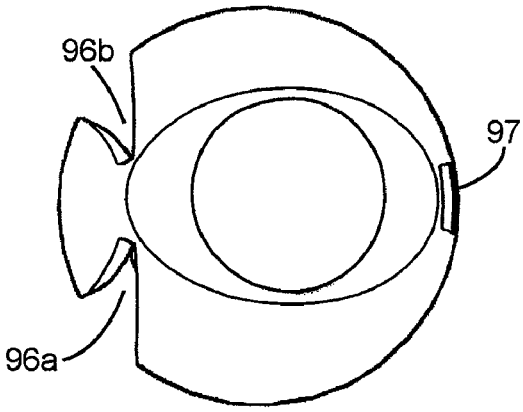
FIGS. 25A and 25B are a front and side angle views, respectively of a system cover for an internal combustion engine embodiment according to a preferred embodiment of the present invention.
Figure 25B:
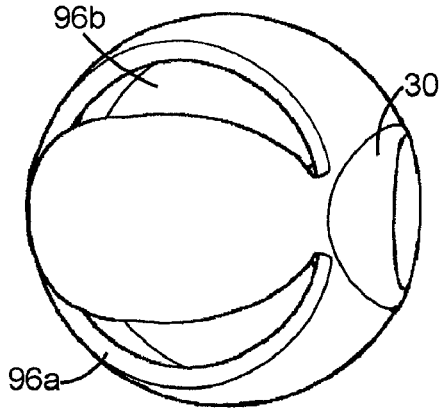

With specific reference to FIGS. 25A and 25B, another alternate cover 94 is shown designed specifically to accommodate the needs of an internal combustion engine. Notably, the cover 94 includes only one input opening 96*a*, for input of the fuel-air mixture, and one output opening 96*b*, for exhaust of the combustion products. In this embodiment, an air fuel mixture is input as a space is expanding, compressed, ignited within the cover 94 at mark 97, expanded (the power stroke) and exhausted. In the case of an internal combustion engine, it is to be noted that the system 100 is operable to provide six power strokes (two for each chamber 112) for every full cycle.

Figure 26:
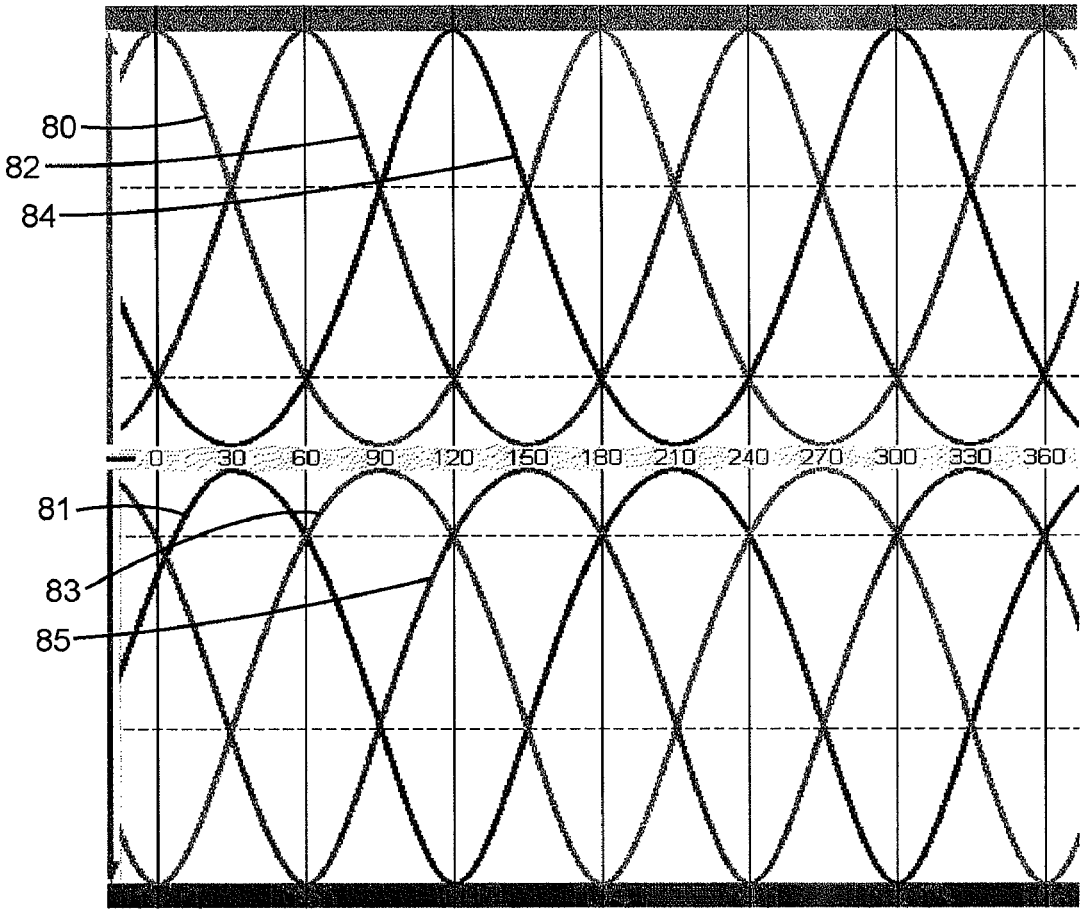
FIG. 26 is a graph of variations of spaces during a cycle of the system of frusto-conical elements according to a preferred embodiment of the present invention.

FIG. 26 graphs the variation in volume of the chambers 112 during a full cycle of the system 100. Like FIG. 12, which graphs the variations of the three chambers associated with a single frusto-conical element 30 in a trihedron 12, FIG. 26 illustrates sinusoidal-like curves 80, 82 and 84 representing the volumes of the three chambers 112 associated with the first group of frusto-conical elements 30. Additionally illustrated are three sinusoidal-like curves 81, 83 and 85 representing the volumes of the three chambers 112 of the second group of frusto-conical elements 30. It is to be noted that none of the six curves 80 to 85 are in phase, although they are symmetric and equally distributed. As such, a more continuous functioning of the system 100, in any of the various embodiments noted herein, as well as other embodiments within the scope of the invention, can advantageously be achieved.

Constraining Means

As with the combination of a single frusto-conical element 30 and a trihedron 12, the system 100 requires constraining means for constraining the elements 30 in alignment between the central and outer shells 102 and 95. Specifically, the constraining means is used to ensure that the inner and outer spherical surfaces 34 and 36 of each element 30 engage the central and outer shells 102 and 94, respectively, each element 30 is in linear contact with its adjacent elements 30 along their respective lateral surfaces 32 and that the chambers 112 are formed between the adjacent elements 30 and the central and outer shells 102 and 94. In addition, the constraining means are used to ensure that the elements 30 are free to roll about one another along their lateral surfaces 32 in a synchronised manner so as to allow a synchronised rolling, and that the synchronised rolling of the elements 30 results in a corresponding synchronised and cyclical change in volume of the chambers 112.

To accomplish this constraining, a number of mechanisms and methods are considered.

Extending and Complementary Portions

Firstly, an extending portion, embodied herein as a rib 114, can be provided protruding from around the lateral surface 32 of a first element 30. This rib is used in conjunction with a complementary portion, embodied herein as a groove 116, is provided extending around the lateral surface of a second element 30. When the elements 30 are properly positioned between the central and outer shells 102 and 94, the rib and groove are operative to align and engage as the elements roll about one another.

The extending and complementary portions 114 and 116 can also be in a number of arrangements, so long as they engage as the adjacent elements roll about one another. Alternatively, the extending and protruding portions 114 and 116 could be toothed surfaces, much like a pair of gears. In addition, four of the eight elements 30 could be provided with extending portions 114 while the other half are provided with complementary portions 116, or all eight could be provided with some combination of both.

Preferably, however, the extending and complementary portions 114 and 116 are a rib 114 and a groove 116 which form the complementary originating circles 10 noted above. As discussed, the complete locus of points forming the originating circle 10 can be found on the surface of the frusto-conical element 10 in two symmetric locations. With further reference now to FIGS. 17A, 17B and 19, these circles 10 advantageously correspond to points of contact between adjacent frusto-conical elements when properly aligned.

The engagement of such ribs 114 with grooves 116 as illustrated herein, allows for a constant engagement between adjacent frusto-conical elements 30. Preferably, the ribs 114 and grooves 116 have round cross-sections.

Because the two loci of circle 10 overlap on the lower portion of each minor side 45 of a given frusto-conical element 30, the rib 114 and the groove 116 also overlap. In operation, this overlap may cause the ribs 116 of two adjacent frusto-conical elements 30 to coincide. To avoid this, the frusto-conical elements 30 can be provided with flattened surfaces, i.e. neither rib nor groove, in the areas of overlap, although other solutions are possible and well within the scope of the present invention.

Conical Belt

Alternatively, the constraining means is embodied by a resilient conical belt 120 used in conjunction with the system 100, as illustrated in FIGS. 20A to 20E. The belt 120 has an annular shape, having an outer radius matching the radius of the outer surface 36 of an element 30, and an inner radius matching the radius of the inner surface 34 of an element. However, its circumference is twice the circumference of an element 30 giving the belt 120 a curved structure as illustrated.

In use, the belt is disposed alternatingly between the lateral surfaces of the secondary input elements 30*b*, 30*c* and 30*d* and the secondary output elements 30*f*, 30*g* and 30*h*, thereby dividing the system 100 and chambers 112 into two halves The belt 120 incorporates a flexibility in order to allow the changing of the sizes of the chambers created between adjacent frusto-conical elements and therefore preferably as a minimal thickness. This belt may be used in conjunction with the ribs 114 and grooves 116 described above in which there are located an ensured alignment.

Preferably, the belt 120 is employed in embodiments where sealing is an issue, such as hydraulic applications.

Rigid Links

One of the elliptical properties of the frusto-conical element 30 is that, as noted, it comprises two focal axes 44 and 46. The focal axes of a cone of the second degree are axes passing through the vertex. With each of the frusto-conical elements 30 aligned such that their vertices are coincident, the distance between the first focal axis 44 of each frusto-conical element 30 and that of any adjacent frusto-conical element 30 is invariable over the cycle. In addition, the angular distance between each focus 44 and a corresponding focus on an adjacent frusto-conical element 30 is equal to the major angle 41. The same is true with the second focus 46 of each frusto-conical element.

Figure 21:
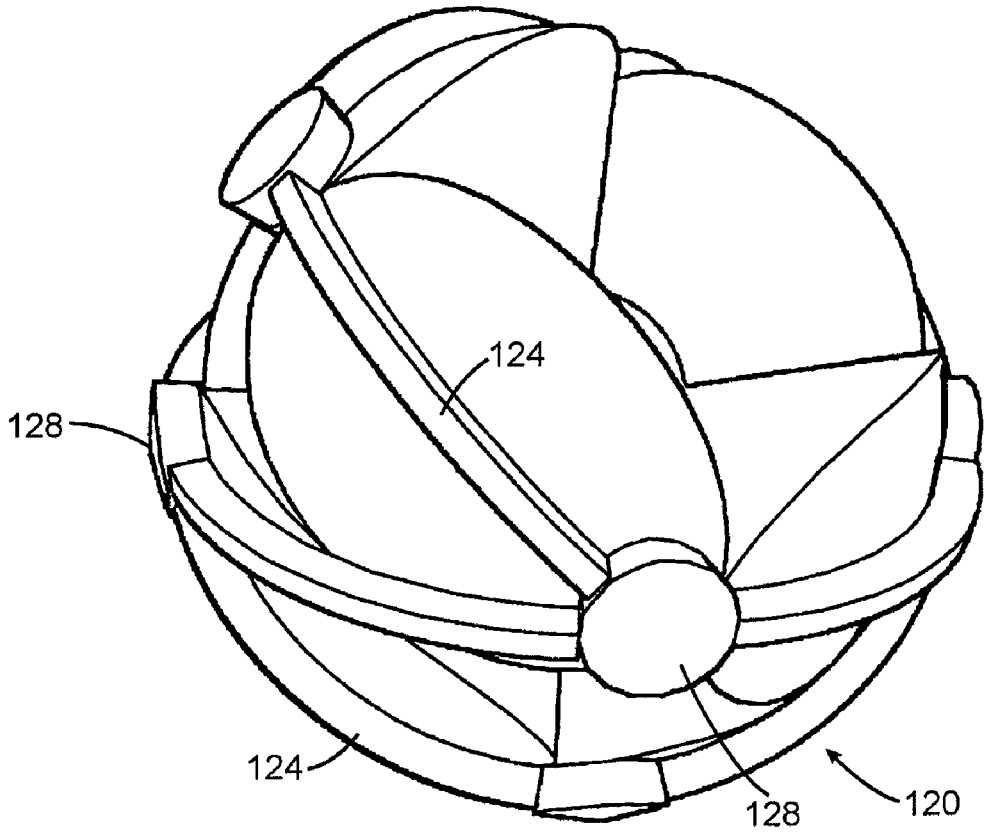
FIG. 21 is an isometric view of a system of frusto-conical elements constrained by a plurality of rigid links according to a preferred embodiment of the present invention.

As illustrated in FIG. 21, this property can be advantageously utilised by designating one of the sets of first focal axes 44 and second focal axes 46 as the "chosen" set and providing a cage 126 of rigid links 124 which attach each frusto-conical element 30 to the three adjacent frusto-conical elements 30 via their first focal axes. Each rigid link having first and second extremities which can pivot with respect to the two frusto-conical elements 30 to which it is attached. In addition, each focus pivot 128 is operable to allow connection of three links 124. Combined, these pivoting links 124 form the cage 126 which retains the system 100.

Pseudo-Elliptical Guides and Rollers

As discussed above with regard to the input and output channels 72*a* and 72*e* illustrated, in FIGS. 17A, 17B and 19 can be given a pseudo-elliptical shape corresponding to that of the path 68 so as to engage with an external component equivalent to the cone 70 for positioning purposes. Similarly, FIG. 19 illustrates a plurality of elliptical guides 134 provided on the outer surface 36 of each remaining element 30. As illustrated herein, the pseudo-elliptical guides 134 are embodied as pseudo-elliptical channels 134 cut into the out surface 36 of the elliptical guides 30. Each pseudo-elliptical channel 134 includes a channel wall extending inwards from the outer surface 36.

Figure 22A:
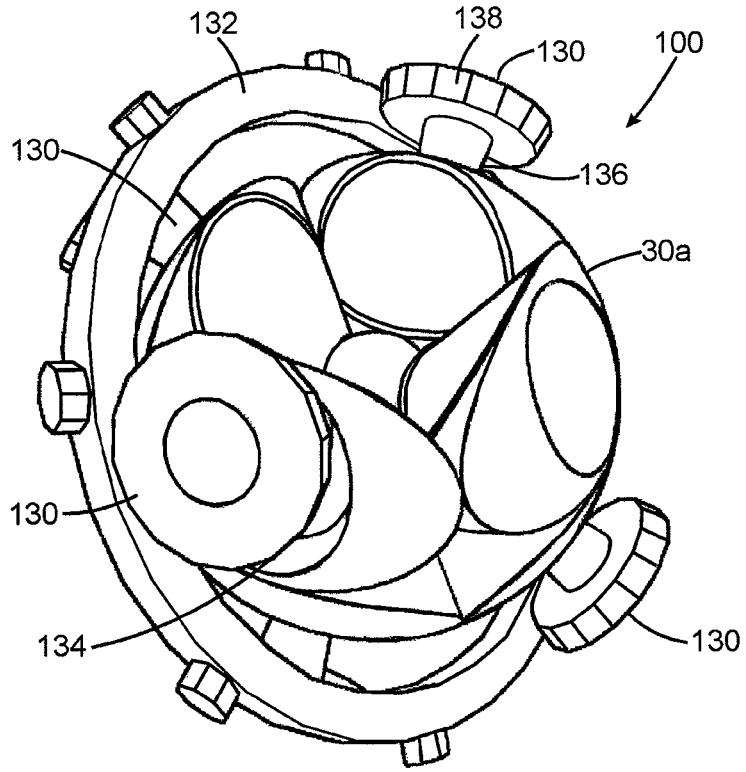
FIGS. 22A and 22B are views of an uncovered system and a covered system of frusto-conical elements, respectively, according to a preferred embodiment of the present invention.
Figure 22B:
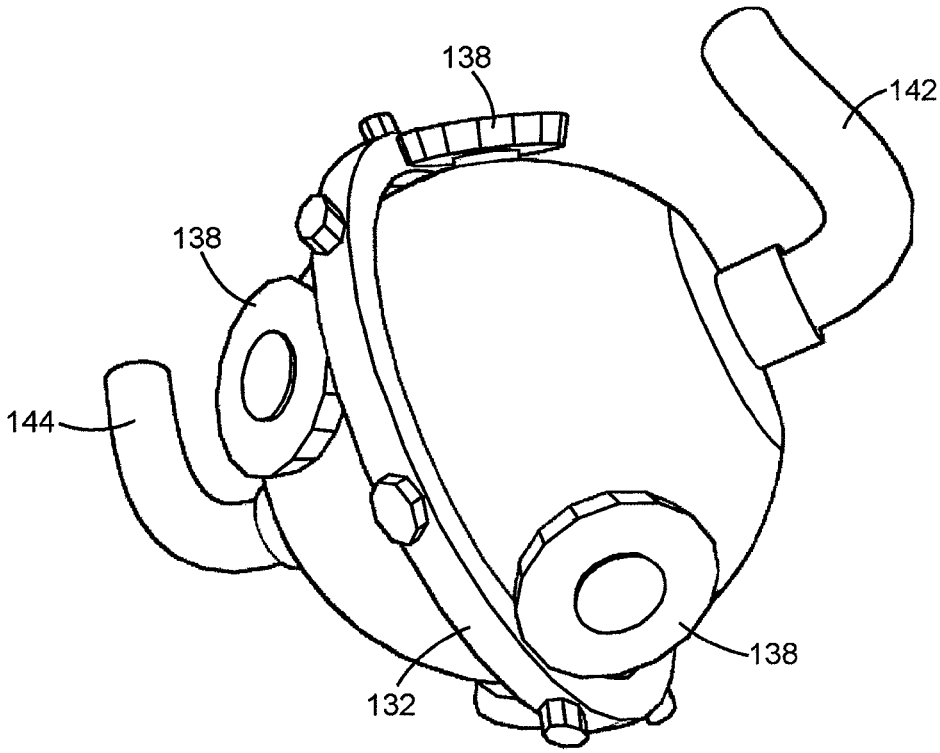

With added reference to FIGS. 22A and 22B in which the system 100 is embodied as a turbine or pump, the pseudo-elliptical guides are described in more detail.

A fluid liquid passing through the system 100 may be used to generate a rotary motion of an external ring 132. Alternatively, this embodiment can be used to generate a flow liquid by rotating the external ring 132. In order to engage this ring 132, a plurality of rollers 130 have been additionally provided. The rollers 130 each engage a respective one of the pseudo-elliptical channels 134 and the outer conical surface 136 engages the channel walls 135 and an axis about which the rollers 130 pivot. In this manner, an element 30 is operable to rotate about a given roller 130 which guides the element 30 as it rolls around the adjacent elements 30.

While it was shown that a void 72 and corresponding cone 70 can be utilised to further constrain an element 30 cycling within a trihedron 12, this property can further be exploited in the system 100 of elements 30. As previously noted, even though the trihedron 12 is not physically present in system 100, its planes are still present in the motion and engagement of the elements 30.

While the cycle of system 30 has previously been considered from the reference frame of the input element 30*a* and output element 30*e*, with the remaining secondary elements 30 cycling thereabout, the system 100 can also be considered from the reference frame of the trihedron 12. As such, the cone 70 and void 72, as discussed with reference to FIGS. 9 and 10, provide axes of rotation which are fixed relative to the trihedron 12, but more importantly relative to each other.

As such, pseudo-elliptical channels 134 are provided in the outer spherical surface 36 of each secondary element 30*b* to 30*d*, and 30*e* to 30*g*. While the pseudo-elliptical channels 134 are shallower than the channel 72 of FIG. 10 and the input and output channels 72*a* and 72*e*, their configuration remains the same (based on the pseudo-elliptical path 68). Because of this, the external rollers 130, which are provided with conical surfaces 136 for engaging the channel walls of the pseudo-elliptical channels 134, rotate about their respective axes which are fixed in space relative to one another. Moreover, this motion is simplified and more easily harnessed, allowing the addition of ring 132 which engages properly dimensioned external roller heads 138.

The system 100 may then be closed with the spherical outer shell 140, which seals the six chambers 112, but leaves external roller heads 138 such that they may engage ring 132. Further provided are input and output ports 142 and 144 which lead to input and output openings in the outer shell 140 and allow the input of a fluid to the input channel 72*a*, and output of a fluid from the output channel 72*e*.

Compressor/Compressed Air-Driven Motor

The system of concentric frusto-conical elements 30 illustrated in FIGS. 27A to 27F and discussed above can be utilised as a compressor. In this embodiment, the cycle of one of the frusto-conical elements can provide the power, while the other provides the compression. For example, the cycle of the outer frusto-conical element 30*b* can be used as an internal combustion engine and the cycle of the inner frusto-conical element 30*a* as a compressor driven by the combustion cycle, both as described hereinabove. An inner shell 33 and an outer cover 94 as discussed above in connection with FIGS. 25A and 25B are provided to provide inputs and outputs to the inner and outer frusto-conical element cycles, respectively. As will be apparent to one of ordinary skill in the art, other configurations providing a power cycle and a compression cycle are well within the scope of the present invention, such as, but in no way limited to, having the compression performed by the outer frusto-conical element 30*b* cycle and driven by the inner frusto-conical element 30*a* cycle.

Such an embodiment of the present invention can have many advantages over present compressors, including, but in no way limited to, the fact that combustion cycle of the outer frusto-conical element 30*b* drives the compression cycle of the inner frusto-conical element 30*a* directly through the post 71. Such a direct power transmission advantageously avoids the need for further connecting apparatus, such as gears or pulleys, which reduce the efficiency of the cycle.

As illustrated in FIG. 27F, such an embodiment of concentric frusto-conical elements can further be extended to a system 100 of frusto-conical elements comprising two layers of frusto-conical elements 30 separated by a spherical shell 37, as opposed to merely a single inner frusto-conical element 30 and outer frusto-conical element 30*b*. In this embodiment, the spherical shell 37 is operable to float in the concentric system 100 between the two layers of frusto-conical elements 30 while being retained in place by its engagement with the posts 71 and respective triangular slots 39.

Further Applications

The system 100 equipped with the rollers 130 and ring 132 can be utilised as a replacement for conventional turbines in hydroelectric applications. Pressurised water can be introduced via the input 142, cycled through the system 100 in order to drive the ring 132 and expelled via output 144 as the rotational motion of ring 132 is used to generate hydroelectricity.

In addition to the rotor and stator discussed herein above, the system 100 could similarly be equipped as an electric motor by providing axial frusto-conical elements 30*a* and 30*e* with permanently magnetised portions and the secondary frusto-conical elements 30*b*, 30*c*, 30*d*, 30*f*, 30*g* and 30*h* with coiled interiors for creating an electromagnetic field. Such an arrangement could therefore be operable to drive a compressor, similar to the internal combustion cycle discussed above.

Moreover, it will be appreciated that the system 100 could furthermore be used as an internal combustion engine.

As will be appreciated, the synchronised rolling within the system 100 drastically reduces the friction between contacting elements which is present in prior systems which provide elements rotating about a central axis.

In addition, it will be appreciated that elliptical shape of the frusto-conical elements provided is smoother in shape than the ovoid elements of the prior art, which are formed from a combination of circles, which may reduce the complexity of the system and vibration therewithin.

Furthermore, cyclical variation in the volume of each of the six chambers 112 is evenly staggered in a "three-phase" manner. As such, any force or motion which results from the cycling of the system 100 will be smoother and more continuous than in prior art systems which provide two sets of chambers in which one is at a maximum when the other is at a minimum, and vice-versa.

While specific embodiments of the present invention have been described and illustrated, it will be apparent to those skilled in the art that numerous modifications and variations can be made without departing from the scope of the invention, as apparent to a person skilled in the art.

The invention claimed is:

1. A system for enabling fluid flow, comprising:

a) a plurality of frusto-conical elements comprising;
   i. a first spherical surface having a first radius;
   ii. a second spherical surface having a second radius, the first and second spherical surfaces sharing a common geometric center; and
   iii. a lateral surface extending between the first and second spherical surfaces, the lateral surface being formed from a section of an elliptical cone and tapering from the second spherical surface to the first spherical surface, an apex of the elliptical cone coinciding with the geometric centre of the first and second spherical surfaces;

b) a spherical central shell having a radius matching the first radius;

c) a spherical outer shell enclosing the central shell and the plurality of frusto-conical elements, the outer shell having a radius matching the second radius;

d) wherein:
   i. the first spherical surface of each frusto-conical element engages the central shell;
   ii. the second spherical surface of each frusto-conical element engages the outer shell;
   iii. each frusto-conical element is in linear contact with at least two adjacent frusto-conical elements along their respective lateral surfaces;
   iv. a plurality of chambers are created between at least some adjacent frusto-conical elements and the central and outer shells; and
   v. the frusto-conical elements are free to roll about one another along their lateral surfaces in a synchronised manner so as to allow a synchronised rolling, and the synchronised rolling of the frusto-conical elements results in a corresponding synchronised and cyclical change in volume of the chambers;

e) input and output ports configured to allow fluid flow into and out of the chambers.

2. The system of claim 1, wherein the plurality of frusto-conical elements consists of eight frusto-conical elements, each frusto-conical element being in linear contact with three adjacent frusto-conical elements, and the plurality of chambers consists of six chambers created between four frusto-conical elements.

3. The system of claim 2, further comprising a conical belt having an inner radius matching the first radius and an outer radius matching the second radius, the conical belt disposed alternatingly between the lateral surfaces of six of the frusto-conical elements for dividing the system and plurality of chambers into two halves.

4. The system of claim 1, comprising:

a) a plurality of pseudo-elliptical guides for guiding the rolling of the frusto-conical elements, each pseudo-elliptical guide being provided on one of the first and second spherical surfaces of a respective one of the frusto-conical elements, each pseudo-elliptical guide being centered on the one of the first and second spherical surfaces; and b) a plurality of rollers, each roller engaging a respective one of the pseudo-elliptical guides, each roller comprising:
   i. an outer conical surface for engaging the respective one of the pseudo-elliptical guides; and
   ii. an axis about which the roller is operable to rotate as the respective one of the frusto-conical elements rolls thereabout, the rolling of the frusto-conical elements about the rollers guiding the rolling of the frusto-conical elements about each other.

5. The system of claim 4, wherein each pseudo-elliptical guide comprises a pseudo-elliptical channel cut into the one of the first and second spherical surfaces of the respective one of the frusto-conical elements, each pseudo-elliptical channel comprising a channel wall, the outer conical surface of each roller engaging a respective channel wall.

6. The system of claim 4, comprising:

a) an input opening in the outer shell for receiving the fluid flow;

b) an input channel extending through a first of the frusto-conical elements and in fluid communication with the input opening;

c) an output opening in the outer shell for releasing the fluid flow;

d) an output channel extending through a second of the frusto-conical elements and in fluid communication with the output opening;

e) a first internal channel located within the central shell allowing fluid to flow from the input channel therethrough and into one of the chambers; and f) a second internal channel located within the central shell allowing fluid to flow from the one of the chambers through the central shell and into the output channel.

7. The system of claim 6, wherein the first and second of the frusto-conical elements are disposed oppositely with respect to the central shell.

8. The system of claim 7, wherein the first and second of the frusto-conical elements are fixed to the central shell.

9. The system of claim 1, wherein each frusto-conical element comprises first and second focal axes passing therethrough and intersecting the second surface, and further comprising a plurality of rigid links for pivotally linking pairs of adjacent frusto-conical elements, each rigid link having first and second extremities pivotally attached to adjacent frusto-conical elements proximate their respective second spherical surfaces and operable to pivot about their respective first focal axes.

10. The system of claim 1, comprising:

a) an input opening in one of the central and outer shells for receiving the fluid flow, the input opening being positioned with respect to the frusto-conical elements so as to be aligned with one of the chambers for a pre-determined portion of its cyclical change in volume;

b) an output opening in one of the central and outer shells for releasing the fluid, the output opening being positioned with respect to the frusto-conical elements so as to be aligned with the one of the chambers for another pre-determined portion of its cyclical changes in volume.

11. The system of claim 10, wherein the input opening is positioned with respect to the frusto-conical elements so as to be aligned with the one of the chambers as it reaches a minimum volume.

12. The system of claim 11, wherein the output opening is positioned with respect to the frusto-conical elements so as to be aligned with the one of the chambers as it reaches a minimum volume.

13. The system of claim 1, comprising:

a) an extending portion protruding from around the lateral surface of a first frusto-conical element; and b) a complementary portion extending around the lateral surface of a second frusto-conical element;

wherein the extending portion and the complementary portion of adjacent frusto-conical elements are operative to align and engage as they roll about one another.

14. The system of claim 13, wherein the extending portion is a rib and the complementary portion is a groove.

* * * * *